US007738828B2

(12) United States Patent
Kimura

(10) Patent No.: US 7,738,828 B2
(45) Date of Patent: Jun. 15, 2010

(54) FIXING DEVICE, FIXING APPARATUS AND IMAGE FORMING APPARATUS

(75) Inventor: Jun Kimura, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 236 days.

(21) Appl. No.: 11/812,759

(22) Filed: Jun. 21, 2007

(65) Prior Publication Data

US 2008/0152401 A1 Jun. 26, 2008

(30) Foreign Application Priority Data

Dec. 26, 2006 (JP) ..... 2006-350162

(51) Int. Cl.
*G03G 15/20* (2006.01)

(52) U.S. Cl. ..... 399/333

(58) Field of Classification Search ..... 399/328, 399/330, 331, 332–334; 430/124.32–124.38
See application file for complete search history.

(56) References Cited

U.S. PATENT DOCUMENTS 5,319,430 A * 6/1994 DeBolt et al. ..... 399/322
5,378,525 A * 1/1995 Yamamoto et al. ..... 428/192
2004/0101334 A1 * 5/2004 Tatematsu et al. ..... 399/329

FOREIGN PATENT DOCUMENTS

JP B2 6-42112 6/1994
JP A 9-152803 6/1997

* cited by examiner

*Primary Examiner*—David M Gray
*Assistant Examiner*—Gregory H Curran
(74) *Attorney, Agent, or Firm*—Oliff & Berridge, PLC

(57) ABSTRACT

A fixing device having at least a cylindrical base material, an elastic layer disposed on the base material, and a surface layer disposed on the elastic layer is provided. The cylindrical base material has a variation in thickness within about ±10% when the cylindrical base material is in an endless belt shape having flexibility, or within a variation in outer diameter within about ±0.5% when the cylindrical base material is in a circular cylinder tube shape having rigidity. The elastic layer has a variation in thickness within about ±5%. The surface layer has a variation, along the circumferential direction of the base material, in thickness of the surface within about ±5% and with a surface elongation percentage which increases from a center portion toward both end portions in the widthwise direction of the base material. A fixing apparatus and an image forming apparatus having the fixing device are also provided.

20 Claims, 16 Drawing Sheets

FIXING DEVICE, FIXING APPARATUS AND IMAGE FORMING APPARATUS

BACKGROUND

1. Technical Field

The present invention relates to a fixing device, a fixing apparatus and an image forming apparatus.

2. Related Art

When an image is formed by use of an electrophotographic process, a fixing apparatus provided with at least one pair of fixing devices disposed in an image forming apparatus so as to face each other to form a contact portion is used, and a toner image formed on a recording medium such as a sheet is fixed.

As the fixing apparatus, one having a configuration where, with a so-called straight shaped fixing member such as a fixing roll in which the outer diameter thereof along the axial direction is constant or a fixing belt in which a thickness thereof across the widthwise direction is constant, a pressing force in the widthwise direction of a contact portion formed by a pair of fixing members that are disposed facing each other is controlled so as to press each other with a constant pressure, is generally widely use. However, fixing apparatuses having other configurations have been conventionally variously proposed.

For example, a fixing apparatus can be cited where a pressing force in the widthwise direction of a contact portion formed by a pair of fixing devices is controlled so as to be small toward the center portion and high on both end portions.

On the other hand, there is also proposed a process where a non-straight fixing device is used.

For example, a pressing rotating body where, in a pressing rotating body formed by forming a rubber layer on a metal core, the shape of the metal core of the pressing rotating body is formed with a diameter set at the maximum at a center portion and tapered down toward both ends, and a thickness of the rubber layer that covers the core metal is formed so as to get thinner on progression from the end portions toward the center portion, is proposed.

Furthermore, besides these, an elastic rotating body where, in an elastic rotating body having a rubber layer and a surface resin layer disposed on the rubber layer, the surface resin layer has a protrusion portion that is continuously disposed along a bus line direction and thicker than other in the layer thickness is proposed.

SUMMARY

The invention provides a fixing device that may inhibit a sheet from wrinkling, may be readily produced, may be easily assembled to a fixing device and may be free from streaky image defects accompanying the fixing, and a fixing apparatus and an image forming apparatus therewith.

Namely, according to an aspect of the invention, there is provided a fixing device including at least:

a cylindrical base material, with a variation in thickness within about ±10% when the cylindrical base material is in an endless belt shape having flexibility, or with a variation in outer diameter within about ±0.5% when the cylindrical base material is in a circular cylinder tube shape having rigidity;

an elastic layer that is disposed on or above the base material and with a variation in thickness within about ±5%; and a surface layer that is disposed on or above the elastic layer, with a variation, along the circumferential direction of the base material, in thickness of the surface layer within about ±5% and with a surface elongation percentage which increases from a center portion toward both end portions in the widthwise direction of the base material.

DETAILED DESCRIPTION

Figure 1:
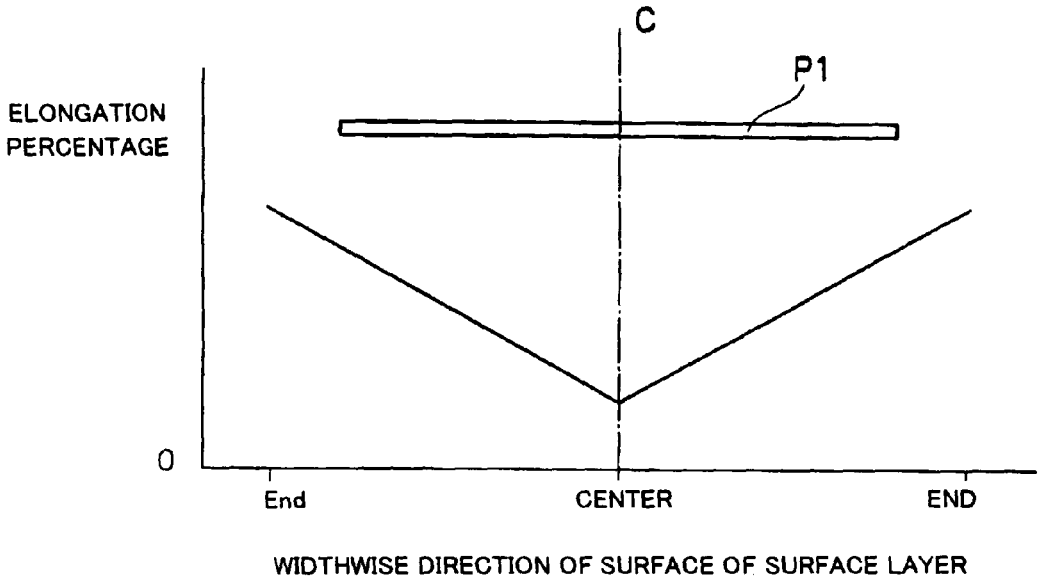
FIG. 1 is a graph showing an example of a profile of variation of the elongation percentage with respect to the widthwise direction of the surface of the surface layer of one exemplary embodiment of the fixing device of the invention.

A fixing device of an exemplary embodiment of the invention includes at least: a cylindrical base material, with a variation in thickness within about ±10% when the cylindrical base material is in an endless belt shape having flexibility, or with a variation in outer diameter within about ±0.5% when the cylindrical base material is in a circular cylinder tube shape having rigidity; an elastic layer that is disposed on or above the base material and with a variation in thickness within about ±5%; and a surface layer that is disposed on or above the elastic layer, with a variation, along the circumferential direction of the base material, in thickness of the surface layer within about ±5% and with a surface elongation percentage which increases from a center portion toward both end portions in the widthwise direction of the base material.

In a case where the base material has a cylindrical shape, the "widthwise direction (of the base material)" herein means the direction of the axial direction of the (cylindrical) base material.

Therefore, according to the fixing device of the exemplary embodiment of the invention, wrinkling of the recording medium can be suppressed. The fixing device of the exemplary embodiment of the invention further has the advantages of the easiness in preparation, the easiness in assembling a fixing apparatus using the fixing device, and the freeness from occurrence of streaky defects in formed images which tends to accompany with a fixation treatment. These effects are expected to be achieved due to the following reasons exemplified hereinafter.

As a first method for suppressing wrinkling of sheets, there is a method in which a fixing roll is formed into a flare shape, i.e., the outer diameter of the fixing roll becomes smaller from the both ends toward the center, in the axial direction as described in JP-A No. 9-152803. However, in the production of the fixing roll used in this method, a mold is used to regulate the shape of the roll in the axial direction so as to be flare-shaped. Therefore, only a fixing roll having a flare shape that is releasable from a mold can be produced.

Additionally, the production yield of such a flare-shaped fixing roll is low, as compared with a case of molding a so-called straight-shaped fixing roll having an outer diameter being constant in the axial direction, due to high incidence of scratches at the time of releasing the roll from a mold. Further, the unit cost of the mold is also high, since the mold for the production of a flare-shaped fixing roll itself requires highly delicate shape regulation as compared with the mold for the production of a straight-shaped fixing roll.

On the other hand, when a roll device (fixing roll) is prepared as a fixing device of the exemplary embodiment, the roll device is produced by a process where a solution for forming a surface layer is coated on a surface of a roll-shaped device (base-roll) of which the outer diameter is constant along the axial direction. Accordingly, when the base-roll is produced, there is no need to use a flare-shaped mold. Furthermore, a surface layer as well may be formed without employing a mold, while details of this process will be described later. This is also the case when an endless belt-shaped device (fixing belt) is formed as a fixing device of the exemplary embodiment.

Accordingly, since there is no need to produce the fixing device to suppress sheet wrinkling by using a flare-shaped mold, there are none of the scratches generated that accompany the use of a flare-shaped mold, and so the fixing device of the exemplary embodiment can be readily produced.

Furthermore, as a second method for suppressing wrinkling of sheets, a process can be cited where an inverse crown-shaped elastic rotating body where a surface resin layer (surface layer) has a protrusion portion that is thicker than other portions in layer thickness and is continuously provided along a direction along a bus line is used as shown in JP-B No. 6-42112. However, in such a process, owing to the presence of the protrusion portion in the surface layer, the conveyance speed of a recording medium that comes into contact with the surface of the elastic rotating body when fixing varies discontinuously around the time the recording medium comes into contact with the protrusion portion; accordingly, streaky image defects are caused in a direction perpendicular to a direction of transporting the recording medium.

On the other hand, in the fixing device of the exemplary embodiment, because the thickness is substantially constant in the circumferential direction of the surface layer, the conveyance speed of the recording medium that comes into contact with a surface of the fixing device at the fixing does not vary discontinuously, in contrast to the above, and the streaky image defects in a direction perpendicular to the conveyance direction of the recording medium are not generated.

A third method for suppressing wrinkling of sheets includes a method of regulating the pressure distribution at the contact portion. In this method, the pressure applied onto the center and the pressure applied onto the both ends are required to be regulated so as to be different from each other, at the time of assembling the fixing apparatus.

It is not easy, however, to regulate the pressure distribution at the contact portion of the fixing roll to be uniform in the widthwise direction for each of fixing devices, which makes the assembling of the fixing device difficult. In addition, fluctuations in the capability to suppress sheets forming wrinkling between fixing devices may tend to occur.

Further, although the fixing roll usually consists of an elastic layer and/or a releasing layer, and a metallic support (so-called core bar) onto which the layers are formed, the elastic layer has recently become thinner in order to meet the reduction in the warm-up time (the period from the point of time when an image forming apparatus is powered up to the point of time when a fixing device is heated to a temperature at which fixing can be performed). Accordingly, the fixing roll having varied outer diameter in the widthwise direction has become less suitable for regulating of the pressure distribution at the contact portion by means of elastic deformation of the fixing roll, and a paper sheet may not be prevented from being creased in some cases.

On the other hand, when one of a pair of fixing devices is a belt-shaped fixing device with a thickness constant in a widthwise direction, the shape of a pressing device (pad) for pressing the belt against the other roll-shaped fixing device is controlled. That is, in order to obtain a desired pressure distribution, in the profile along the widthwise direction of the surface that comes into contact with the belt of the pressing device needs to be processed very precisely so as to form a curve. However, in this case, the shape precision inevitably fluctuates between pads; accordingly, there is a tendency for the distribution of the pressing force in a widthwise direction of the contact portion to be largely affected, and readily leading to the generation of fluctuations in the capability to suppress sheets forming wrinkling between fixing devices.

Further, as compared with the cases where the fixing apparatus is assembled using straight-shaped fixing rolls so that the pressure distribution at the contact portion is substantially uniform (the difference in the widthwise direction between the maximum and minimum values in the suppress strength at the pressure contact portion is within about ±10%), there is also a tendency of causing fluctuation in the capability to suppress sheets forming wrinkling among the fixing devices when a fixing roll having a graded outer diameter (shape) in the axial direction as described above is used, or when a fixing apparatus in which a belt-shaped fixing member is pressed against a roll-shaped fixing device by a pad is assembled due to a fluctuation between the pressure applied onto the center of the contact portion and the pressure applied onto the both ends caused by a subtle difference in the size of the fixing devices (including a pad if it is used) or a subtle difference in the position of the fixing devices to be combined.

In contrast, in the fixing device of the exemplary embodiment, by making use of a configuration where the surface elongation percentage of the surface layer increases in the widthwise direction from a center portion toward both end portions, sheets are suppressed from wrinkling; accordingly, when a fixing device is assembled with the fixing device of the exemplary embodiment, there is no need to make adjustments so that a desired difference is generated between the pressing forces applied on the center portion side and end portion sides of the contact portion.

That is, in a fixing device provided with the fixing device of the exemplary embodiment and a fixing device disposed so as to come into contact with the fixing device, the distribution of the pressing force in the widthwise direction of the contact portion can be made similar to that of a fixing device that uses a straight-shaped fixing roll; accordingly, the fixing device can be readily assembled.

The fixing device of the exemplary embodiment will be hereinafter described in more detail.

A layer configuration of the fixing device of the exemplary embodiment includes a cylindrical base material, an elastic layer and a surface layer laminated in this order. As needs arise, an intermediate layer, such as a primer layer between the base material and the elastic layer or between the elastic layer and the surface layer, may be further provided to improve the adhesiveness. In the exemplary embodiment, the surface layer (hereinafter, in some cases referred to as a "releasing layer") has releasing properties with respect to a toner and is configured by including a solid fluorine-containing material such as a fluororesin or a fluororubber. Furthermore, the elastic layer means a layer which is at least capable of elastically deforming and is usually formed including an elastic material.

When the cylindrical base material that constitutes the fixing device of the exemplary embodiment is shaped as a flexible endless belt, the variation in thickness thereof is within ±10%. When the cylindrical base material is a stiff circular cylinder tube, the variation of the outer diameter thereof is within ±0.5%. Furthermore, the variation in thickness of the elastic layer that constitutes the fixing device of the exemplary embodiment is within ±5%.

That is, the device (hereinafter, in some cases, referred to as a "cylindrical support") that is constituted of a cylindrical base material and an elastic layer disposed on the base material, when the cylindrical base material is an endless belt-shaped base material that is constituted of a heat-resistant resin and has flexibility to the extent such that it can be freely deformed when tension is applied by use of a roll, the cylindrical base material is formed with a shape of constant thickness.

Furthermore, when the cylindrical base material is a circular cylinder-shaped base material having the stiffness (rigidity) necessary for a core material of a roll-shaped core device such as a metal circular cylinder tube, it has a shape in which outer diameter is constant, that is, a straight shape in which the outer diameter is constant along the widthwise direction (axial direction).

Accordingly, when the fixing device of the exemplary embodiment is for example a fixing roll, when the fixing roll is prepared, at the preparation of a fixing device (cylindrical support) before forming a surface layer, there is no need to use a flare-shaped mold. Accordingly, in comparison to a fixing roll produced by use of a conventional flare-type mold, it can be readily produced. This is also applied when a fixing belt with varying thickness in the widthwise direction is prepared by use of a mold.

When in the case where the shape of a cylindrical base material is endless belt-shaped the variation in thickness is outside of about ±10%, uneven wear of a surface of the fixing device and a phenomenon whereby the sheet is displaced toward one or other of the left or right sides in a widthwise direction during rotation, so-called walk, are generated. In addition, when the thickness intentionally varied along the widthwise direction so as to be outside of the range, the thickness in the widthwise direction must be controlled, and the manufacturability of the base material deteriorates. The variation in thickness is preferably within about ±8%.

Furthermore, when the shape of the cylindrical base material is a circular cylinder tube if the variation of the outer diameter is outside of the range of within about ±0.5%, owing to uneven wear of a surface of the fixing device and a larger variation amount of a conveyance speed of sheets caused thereby, image defects are caused. In addition, when the thickness is intentionally varied along the widthwise direction (axial direction) to be outside of the range, an outer diameter control in a widthwise direction by means of for example a drawing process of a metal circular cylinder becomes necessary, to deteriorating the manufacturability. The variation of the outer diameter is preferably within about ±0.4%.

Still further, when the variation in thickness of the elastic layer is outside of the range of within ±5%, owing to uneven wear of the surface of the fixing device and difference of the surface hardness due to thickness difference, in some cases, unevenness in image gloss may be caused. In addition, when the thickness is intentionally varied along the widthwise direction to be outside of the range, thickness control along the widthwise direction by using, for example a mold, becomes necessary, resulting in deteriorating manufacturability of the elastic layers. The variation in thickness is preferably within about ±3%.

When the shape of the cylindrical base material is shaped as an endless belt, the variation in thickness is obtained as follows. That is, thicknesses are measured at 24 points in total, which are obtained by equally dividing the base material along the circumferential direction thereof into eight at eight points, followed by dividing each of the widthwise directions into four at three points, the average value, the maximum value and the minimum value at each of the 24 measurement points are obtained, and a positive variation value and a negative variation value, respectively, are obtained as 100×(maximum value−average value)/average value, and 100×(minimum value−average value)/average. The thickness of the base material at each of the measurement points is obtained by observing a section of the base material under an optical microscope.

Furthermore, when the shape of the cylindrical base material is a circular cylinder tube-shaped, the variation of the outer diameter is obtained as follows. That is, outer diameters are measured at 24 points in total obtained by equally dividing the base material along the circumferential direction thereof into eight at eight points, followed by dividing each of the widthwise directions into four at three points, an average value, the maximum value and the minimum value at the 24 measurement points are obtained, and a positive variation value and a negative variation value, respectively, are obtained as 100×(maximum value−average value)/average value and 100×(minimum value−average value)/average. The thickness of the base material at each of measurement points is obtained by observing a section of the base material under an optical microscope.

Still further, the variation in thickness of the elastic layer is obtained as follows. That is, thicknesses of the elastic layer are measured at 24 points in total obtained by equally dividing a fixing device along a circumferential direction thereof into eight at eight points, followed by dividing each of widthwise directions four at three points, the average value, the maximum value and the minimum value at the 24 measurement points are obtained, and a positive variation value and a negative variation value, respectively, are obtained as 100×(maximum value−average value)/average value, and 100×(minimum value−average value)/average. The thickness of the elastic layer at each of measurement points is obtained by observing a section of the base material under an optical microscope.

Furthermore, the variation in thickness of a surface layer that constitutes the fixing device of the exemplary embodiment, along the circumferential direction of the base material, is within about ±10%. When the variation in thickness along the circumferential direction is outside of the range, irregularities are caused on the surface of the surface layer in the circumferential direction, it may result in the generation of streaky image defects. The variation in thickness is preferably within about ±7% and more preferably within about ±5%.

Here, the variation in thickness in the circumferential direction is obtained as follows. That is, in each of three points that divide the widthwise direction into four, an average value, the maximum value and the minimum value of thicknesses of the surface layer at eight points that equally divide the fixing device into eight with respect to the circumferential direction thereof are obtained, followed by obtaining a positive variation value and a negative variation value, respectively, as 100×(maximum value−average value)/average value, and 100×(minimum value−average value)/average. The operation is carried out for all three points that divide the widthwise direction into four to obtain respectively the positive variation value and negative variation value at the three points in the widthwise direction, and the maximum positive variation value and the negative variation value are obtained as a positive thickness variation value and a negative variation in thickness value. Here, surface layer thicknesses at the respective measurement points are measured by observing a section of the fixing device under an optical microscope.

Furthermore, in the fixing device of the exemplary embodiment, the surface elongation percentage of the surface layer in the widthwise direction increases from a center portion toward both end portions.

When fixing, a recording medium passes through a contact portion so that the center portion (the center portion in the widthwise direction of the surface layer) of the contact portion formed of a pair of fixing devices at least one of which is formed of the fixing device of the exemplary embodiment coincides with the centerline (a line that is parallel to the conveyance direction of the recording medium and divides the recording medium into two in a direction perpendicular to the conveyance direction) of the recording medium that goes through the contact portion.

Accordingly, the conveyance speed of the recording medium going through the contact portion is lowest at the center portion and faster on both end portion sides, and, a force pulling toward the two sides is applied to the recording medium going through the contact portion, in a direction perpendicular to the conveyance direction, to suppress sheets from wrinkling.

However, when a ratio of the maximum value to the minimum value of the elongation percentages in the widthwise direction (the maximum elongation percentage ratio (maximum value/minimum value)) is too small, in some cases, suppression of wrinkling of a sheet can be difficult. Accordingly, the maximum elongation percentage ratio is preferably at least about 1.25 times or more. The upper limit of the maximum elongation percentage ratio Δg is not particularly restricted, however, in some cases, forming the surface layer becomes difficult; accordingly, in practice, the maximum elongation percentage ratio is preferably about 2.5 times or less.

The elongation percentage in the circumferential direction of the surface of the surface layer is not particularly restricted, as long as, at any position of the surface of the surface layer, the elongation percentage of the surface of the surface layer increases in the widthwise direction from the center portion thereof toward both end portions. However, usually, the elongation percentage in the circumferential direction is preferred to be constant. Here, "the elongation percentage of the surface of the surface layer in the circumferential direction being constant" means that the difference of the maximum value and minimum value is about 10% or less of the elongation percentages at eight positions that equally divide the fixing device in the circumferential direction into eight.

Furthermore, "the elongation percentage of the surface of the surface layer in the widthwise direction increasing from the center portion thereof toward both end portions" includes not only cases where the elongation percentage monotonically increases from a center portion toward both end portions but also a case where the elongation percentage increases as a whole, while having a number of increases and decreases thereof when moving from the center portion toward both end portions.

Whether the elongation percentage "increases as a whole" or not can be determined as follows. That is, a profile of actual elongation percentage is divided at the center portion thereof and, with the center portion as a starting point, the variation of the elongation percentages up to the respective end portions are approximated with straight lines, respectively, and whether the elongation percentage linearly increases from the center portion toward both end portions, or not, is thereby determined.

Furthermore, the elongation percentage "monotonically increasing from the center portion toward both end portions" means that, when proceeding from the center portion toward the two end portions, the elongation percentage always continues to increase, without changing to a decrease in some sections in a widthwise direction, or the elongation percentage, even when it is maintained at a constant value in some sections in the widthwise direction, continues increasing in the other sections.

In the elongation percentage of the surface of the surface layer in the widthwise direction, an increasing tendency from the center portion toward one end portion and an increasing tendency from the center portion toward the other end portion are preferably symmetrical, with the center portion as a reference. When the increasing tendency from the center portion toward one end portion and the increasing tendency from the center portion toward the other end portion are asymmetrical, with the center portion as a reference a recording medium that has passed through the contact portion formed by the pair of fixing devices may be, in some cases, ejected from a fixing device displaced from the center portion toward one end portion side. Furthermore, the force pulling the recording medium in a direction perpendicular to the conveyance direction of the recording medium becomes asymmetrical between the left and right side with respect to the centerline of the recording medium; accordingly, conversely, in some cases, sheets become more readily wrinkled.

Here, "in the elongation percentage of the surface of the surface layer in the widthwise direction, an increasing tendency from a center portion toward one end portion and an increasing tendency from the center portion toward the other end portion being symmetrical, with the center portion as a reference" means that the elongation percentages at any two points distanced by the same distance from the center portion toward the both end portions are substantially same (the difference of the elongation percentages of the surface layer at the two points being within about 10% with respect to the smaller of the two elongation percentages).

Furthermore, in the exemplary embodiment, "the center portion" means as a general rule the exact midpoint between one end and the other end in a widthwise direction of the surface layer. When the length in a widthwise direction of the surface layer is, for example, 300 mm, a position at 150 mm from one end toward the other end becomes the center portion.

This is because, in a general image forming apparatus, a recording medium conveyance path in an image forming apparatus is constituted so that the recording medium may go through a contact portion so that the centerline of the recording medium that goes through the contact portion formed by a pair of fixing devices coincides with the center point in the widthwise direction of the surface layer.

However, when a recording medium conveyance path in an image forming apparatus is constituted so that the recording medium may go through a contact portion so that the centerline of a recording medium that goes through a contact portion formed by a pair of fixing devices coincides with a predetermined position displaced toward one or other of end sides from the center point in the widthwise direction of the surface layer, the predetermined position becomes the center portion. In this case, in practice, the center portion is preferably set within about 60 mm, and more preferably within about 50 mm, toward any one of the end portions from the center point.

In the exemplary embodiment, the elongation percentage is measured as follows.

After a test sample is cut into a width of 5 mm and set in a tool with a distance between chucks set at 5 mm, by use of a thermomechanical analyzer (trade name: TMA-60, manufactured by Shimadzu Corporation), the elongation percentage at a temperature of 170° C. and an applied load of 50 g is measured.

When a test sample cut out of a fixing device is prepared, rubber adhered to the back surface of the surface layer is appropriately dissolved and cleaned off with acid/alkali to obtain the surface layer alone as the sample, followed by similarly cutting into the evaluation sample width, further followed by measuring.

Now, the mode of variation of the elongation percentage of the surface of the surface layer in the widthwise direction will be described with reference to the drawings.

FIG. 1 is a graph showing an example of a profile of variation of the elongation percentage with respect to the widthwise direction of the surface of the surface layer of a fixing device, a horizontal axis denoting the widthwise direction of the surface of the surface layer and a vertical axis denoting the elongation percentage. Furthermore, in the drawing, reference P1 shows the size of a recording medium that goes through the contact portion and the passing position at the contact portion (the length in the widthwise direction of the surface of the surface layer and the contact position of the recording medium to the widthwise direction of the surface of the surface layer) and the dotted chain line shown with reference C denotes the centerline of the recording medium (the center point of the length in the widthwise direction of the surface of the surface layer). Here, in an example shown in FIG. 1, it is shown that the recording medium goes through the contact portion so that the centerline C of the recording medium coincides with the center portion of the surface of the surface layer.

In the example shown in FIG. 1, an example of a profile is shown where, on proceeding from the center portion toward both end portions, the elongation percentage monotonically increases. Accordingly, when a fixing device having a profile shown in FIG. 1 is used, wrinkling of a sheet can be suppressed. In the increasing profile shown in FIG. 1, the elongation percentage linearly increases on proceeding from the center portion toward both end portions. However, the elongation percentage may monotonically increase so as to depict a curve.

Figure 2:
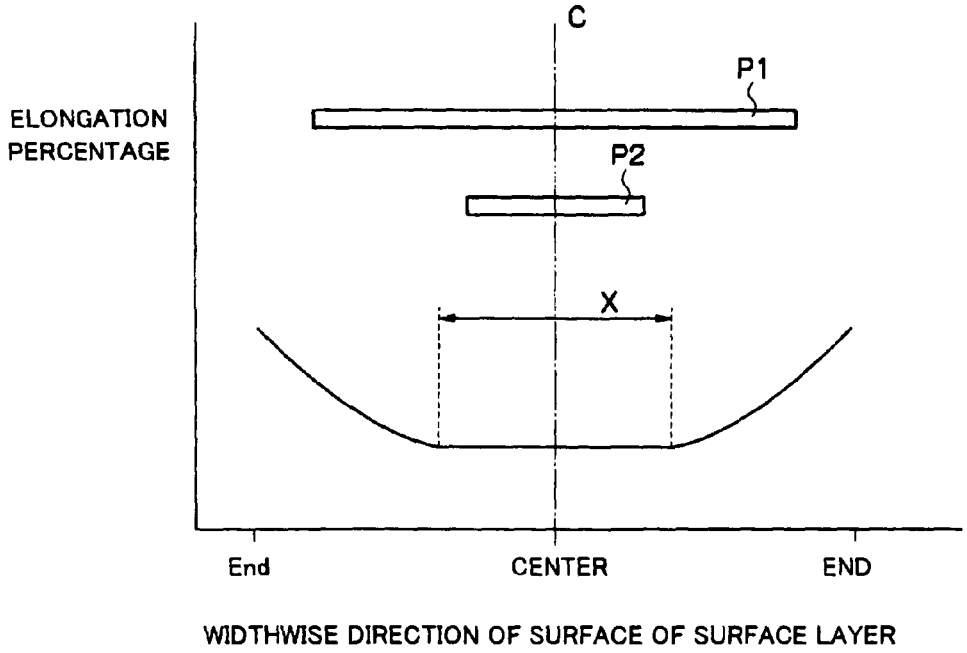
FIG. 2 is a graph showing an example of a profile of variation of the elongation percentage with respect to the widthwise direction of the surface of the surface layer of another exemplary embodiment of the fixing device of the invention.

FIG. 2 is a graph showing another example of a profile of variation of the elongation percentage with respect to the widthwise direction of the surface of the surface layer of a fixing device, the horizontal axis showing the widthwise direction of the surface of the surface layer and the vertical axis showing the elongation percentage. Furthermore, references P1 and C are similar to those shown in FIG. 1, and reference sign P2 denotes the size of a recording medium that goes through the contact portion and the pass position of the contact portion (the length in the surface widthwise direction of the surface layer and the contact position of the recording medium with respect to the surface widthwise direction of the surface layer). However, with the recording medium P1 as a reference, the recording medium P2 is assumed to be within substantially about ½ to about ⅕ thereof, with regard to length in the surface widthwise direction of the surface layer. Furthermore, in the drawing, a width shown with X is slightly larger than the length of the recording medium P2 in the surface widthwise direction of the surface layer (the width shown by X relative to the width of the recording medium P2 is in the range of about 1.1 times or more and about 1.5 times or less).

An example shown in FIG. 2 has a profile where, fundamentally, on proceeding from the center portion toward both end portions, the elongation percentage increases as a whole. However, within the profile, the elongation percentage in the vicinity of the center portion (the region shown with X in the drawing) has a constant value in the widthwise direction and, on proceeding from both sides of the vicinity of the center portion toward both end portions, the elongation percentage increases, tracing out a slight curve close to a straight line.

According to the profile shown in FIG. 2, although, to the recording medium P1, a force pulling toward both end sides, with respect to the conveyance direction, is applied to the recording medium P1, in the region where the recording medium P2 passes through (within the region shown with X), since the elongation percentage is constant along the widthwise direction, there is no force pulling toward both sides with respect to the conveyance direction applied to the recording medium P2. Accordingly, a force that suppresses sheets from wrinkling is applied to the recording medium P1, but, a force that suppresses the sheets from wrinkling is not applied to the recording medium P2.

Thus, as one exemplary embodiment of a fixing device of the exemplary embodiment, as shown as an example in FIG. 2, a configuration having an elongation percentage profile whereby a force that can suppress wrinkling of a sheet is selectively applied only to a recording medium having a particular size may be formed.

For example, when the recording medium P1 is a recording medium that tends to cause a wrinkle on a sheet such as an A4 or A3 size sheet, and the recording medium P2 is a small size recording medium such as a post card size where it is intrinsically difficult for wrinkles to occur on the sheet, a fixing device of an exemplary embodiment having an elongation percentage profile where a force that can suppress wrinkling of a sheet is selectively applied only to a recording medium of a particular size may be used.

There may be the cases where wrinkle on a sheet cannot be prevented due to the difficulty in acting the force to stretch the recording medium toward the both sides in the delivery direction, when the degree of the variation in the elongation percentage in the widthwise direction is relatively low against the size of the recording medium passing through the contact portion.

The size in the widthwise direction of the fixing device used in the fixing apparatus also depends on whether an image forming apparatus equipped with the fixing apparatus is a large machine generally for use in an office or the like where A3- or B5-size paper sheets are also printed in addition to A4-size paper sheets, or a small machine generally for use at home where postcard papers are also printed in addition to A4- or B5-size paper sheets.

When such situations are taken into consideration, in the case of a fixing device capable of longitudinally feeding mainly A3 sheets, including at the maximum A3+ size sheets, that is, in the case where the length of the surface layer in a widthwise direction is 320 mm to 360 mm, a ratio (B2/A2) of the elongation percentage (A2) at a center portion of a surface layer with respect to the elongation percentage (B2) at positions distanced by 160 mm in the widthwise direction from the center portion toward the both end portion sides is preferably in the range of about 1.25 to about 2.5.

When the ratio (B2/A2) of the elongation percentage (A2) at the center portion of the surface layer and the elongation percentage (B2) at positions distanced by 160 mm from the center portion toward the both end portion sides is less than about 1.25, in some cases, it may become difficult to suppress wrinkling of the sheet. On the other hand, when the ratio (B2/A2), of the elongation percentage (A2) at the center portion of a surface layer and the elongation percentage (B2) at positions distanced by 160 mm from the center portion toward the both end portion sides, exceeds about 2.5, since the force by which the recording medium is drawn toward a direction perpendicular to the conveyance direction thereof becomes too strong, in some cases, wrinkles giving a corrugated feeling are generated on the sheet.

On the other hand, in the case of a fixing device capable of longitudinally feeding mainly A4 sheets, that is, in the case where the length of the surface layer in a widthwise direction is 220 mm to 250 mm, a ratio (B1/A1) of the elongation percentage (A1) at a center portion of a surface layer with respect to the elongation percentage (B1) at positions distanced by 110 mm in the widthwise direction from the center portion toward the both end portion sides is preferably in the range of about 1.25 to about 2.5.

When the ratio (B1/A1) of the elongation percentage (A1) at the center portion of the surface layer and the elongation percentage (B1) at positions distanced by 110 mm from the center portion toward the both end portion sides is less than about 1.25, in some cases, it may become difficult to suppress wrinkling of the sheet. On the other hand, when the ratio (B1/A1), of the elongation percentage (A1) at the center portion of a surface layer and the elongation percentage (B1) at positions distanced by 110 mm from the center portion toward the both end portion sides, exceeds about 2.5, since the force by which the recording medium is drawn toward a direction perpendicular to the conveyance direction thereof becomes too strong, in some cases, wrinkles giving a corrugated feeling are generated on the sheet.

A method of controlling a variation of the elongation percentage of a surface of the surface layer in a widthwise direction is not particularly restricted. Examples thereof include the following two methods of controlling the elongation percentage.

First Method of Controlling Elongation Percentage

A first method of controlling the elongation percentage is a method including reducing the thickness of the surface layer in the widthwise direction from the center portion toward both end portions.

When the thickness of the surface layer is varied in the widthwise direction, an elastic deformation amount, that is, the elongation percentage, of the surface of the surface layer at the contact portion formed when a pair of fixing devices are brought into pressing contact with each other so that a pressing force along the widthwise direction may be uniform, becomes smaller at locations where the surface layer is thick and larger at locations where the surface layer is thin.

The first method controls the elongation percentage of the surface of the surface layer by utilizing a difference in the thickness of the surface layer along the widthwise direction. Accordingly, from the viewpoint of the controllability of the elongation percentage in the widthwise direction, it is particularly preferable that only one kind of material is selected as the material composition that constitutes the surface layer.

Here, "the thickness of the surface layer decreasing along the widthwise direction from the center portion toward both end portions" includes not only a case where the thickness decreases monotonically from the center portion toward both end portions but also a case where the thickness decreases as a whole, from the center portion toward both end portions, while increasing and decreasing a number of times.

Whether the thickness of a surface layer "decreases as a whole" or not can be determined depending on whether the thicknesses decrease linearly from the center portion toward both end portions, or not, when a profile of an actual surface layer thickness is divided at the center portion and thickness variations from the center portion as a starting point up to the respective end portions, respectively, are approximated with linear lines.

Furthermore, that "a thickness decreases monotonically from the center portion toward both end portions" means that, on proceeding from the center portion toward both end portions, the thickness continues to always decrease without changing to an increase in some sections along the widthwise direction, or even though a constant value is maintained in some sections in the widthwise direction, the thickness continues decreasing in sections other than the above.

Furthermore, as to the thickness of the surface layer in the widthwise direction, the decreasing tendency thereof from the center portion toward one end portion is preferably symmetrical with the decreasing tendency from the center portion toward the other end portion, with the center portion as a reference. When the decreasing tendency from the center portion toward one end portion and the decreasing tendency from the center portion toward the other end portion are asymmetrical with the center portion as a reference, in some cases, a recording medium that goes through a contact portion formed by a pair of fixing devices may be ejected from a fixing device displaced from the center portion toward one end portion side. Furthermore, the force pulling the recording medium in a direction perpendicular to the conveyance direction of the recording medium becomes asymmetrical at the left and right with respect to the centerline of the recording medium; accordingly, conversely, in some cases, sheets tend to be wrinkled.

Here, "in the thickness of the surface layer along the widthwise direction, the decreasing tendency from a center portion toward one end portion being symmetrical to the decreasing tendency from the center portion toward the other end portion, with the center portion as a reference" means that the thicknesses of the surface layer at any two points distanced by the same distance from the center portion toward the both end portions are substantially the same (the difference of the thicknesses of the surface layers at two positions is within ±5% with respect to a thickness of any one of the positions).

Second Method of Controlling Elongation Percentage

A second method of controlling the elongation percentage includes varying the composition of material that constitutes the surface layer along the widthwise direction from the center portion toward both end portions can be cited. Specifically, the center portion side of the surface layer is configured of material with a large elastic deformation amount, that is a large elongation percentage, and end portion sides of the surface layer are formed of material with a low elongation percentage. For example, in the case of, a fluororesin such as a tetrafluoroethylene perfluoroalkyl vinyl ether copolymer (hereinafter, in some cases, referred to as "PFA") being used as a main material that constitutes the surface layer, by varying a copolymerization ratio of two kinds of monomers that are used to polymerize a PFA, a PFA with a large elongation percentage and a PFA with a small elongation percentage can be prepared. When the surface layer is formed by varying the mixing ratio of the two kinds of PFAs along the widthwise direction of the surface layer, the elongation percentage of the surface of the surface layer in the widthwise direction can be controlled.

In the second method, the elongation percentage of the surface of the surface layer is controlled by use of a variation of the material composition that constitutes the surface layer in the widthwise direction. Accordingly, from the viewpoint of the controllability of the elongation percentage in the widthwise direction, the thickness of the surface layer in the widthwise direction is particularly preferably made constant. However, as needs arise, the first and second methods may be combined.

The surface layer formed by any one of the first and second methods of controlling the elongation percentage can be readily prepared by use of an inkjet method described below.

Mode of Variation of Thickness of Surface Layer in Widthwise Direction

Now, in the first method of controlling the elongation percentage, a mode of variation of the thickness of the surface layer in the widthwise direction will be described with reference to the drawings.

Figure 3:
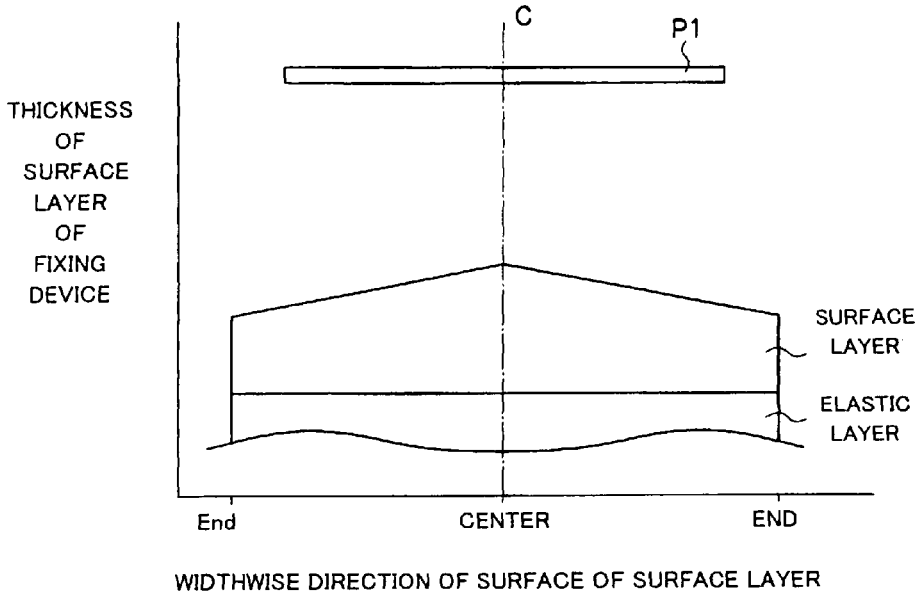
FIG. 3 is a graph showing an example of a profile of variation of the thickness of the surface layer to the widthwise direction of the surface layer of one exemplary embodiment of the fixing device of the invention.

FIG. 3 is a graph showing an example of a profile of variation of the thickness of the surface layer to the widthwise direction of the surface layer of a fixing device, the horizontal axis expressing the widthwise direction of a fixing device (surface layer), the vertical axis expressing the thickness of the fixing device (surface layer). Furthermore, in the drawing, reference P1 shows the size of a recording medium that passes through a contact portion and the passing position of the contact portion (the length in the widthwise direction of the surface layer and the contact position of a recording medium in the widthwise direction of the surface layer) and a dotted chain line shown with a reference sign C denotes a centerline of the recording medium (a center point of a length in a widthwise direction of a surface layer). Here, in an example shown in FIG. 3, it is shown that the recording medium goes through the contact portion so that the centerline C of the recording medium coincides with the center portion of a surface layer.

FIG. 3 shows an example of a profile where, on proceeding from the center portion toward both end portions, the thickness of the surface layer monotonically decreases. Accordingly, when a fixing device having a profile shown in FIG. 3 is used, wrinkling of a sheet can be suppressed. Although in the decreasing profile shown in FIG. 3 the thickness linearly decreases on proceeding from the center portion toward both end portions, the thickness of the surface layer may monotonically decrease so as to trace out a curve.

Figure 4:
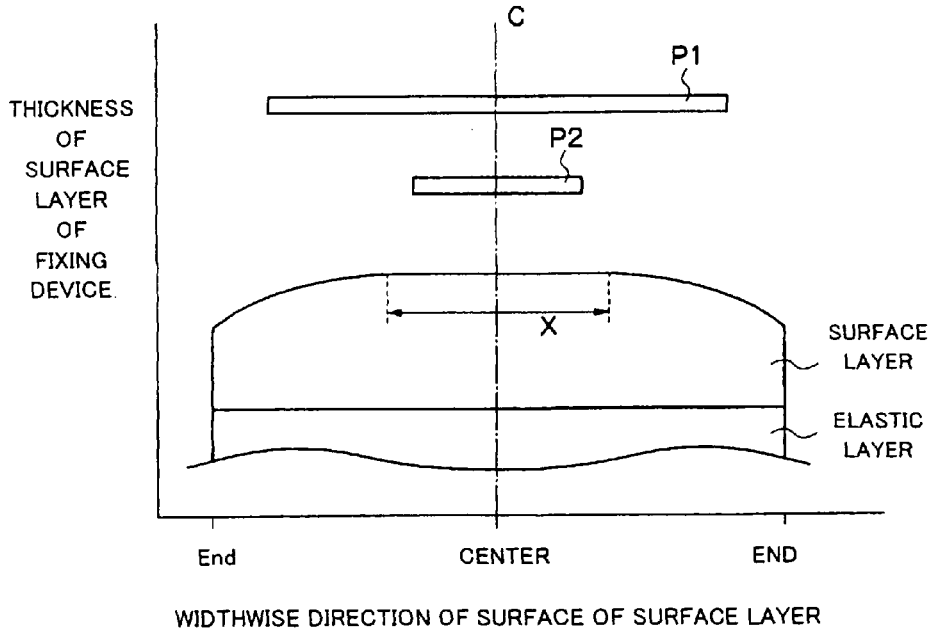
FIG. 4 is a graph showing an example of a profile of variation of the thickness of the surface layer to the widthwise direction of the surface layer of another exemplary embodiment of the fixing device of the invention.

FIG. 4 is a graph showing another example of a variation profile of the thickness of a surface layer along a widthwise direction of a surface layer of a fixing device, the horizontal axis denoting the widthwise direction of a fixing device (surface layer) and the vertical axis denoting the thickness of the fixing device (surface layer). Furthermore, references P1 and C are the same as those shown in FIG. 3, and a reference sign P2 shows the size of a recording medium that passes through a contact portion and the pass position of the contact portion (the length in the widthwise direction of the surface layer and the contact position of the recording medium in the widthwise direction to the surface layer). However, as to a length in the widthwise direction of a surface layer, the recording medium P2 is assumed to be within substantially a range of about ½ to about ⅕ with respect to the recording medium P1 as a reference. Furthermore, in the drawing, the width shown with X is slightly larger than the length in the widthwise direction of the surface layer of the recording medium P2 (the width shown by X relative to the width of the recording medium P2 is in the range of about 1.1 times to about 1.5 times).

An example shown in FIG. 4 has a profile where, fundamentally, on proceeding from the center portion toward both end portions, the thickness of the surface layer decreases as a whole. However, in the profile, the thickness of the surface layer in the vicinity of the center portion (the region shown with X in the drawing) has a constant value along the widthwise direction and, on proceeding from both sides of the vicinity of the center portion toward both end portions, the thickness of the surface layer decreases tracing out a slight curve close to a straight line.

In the profile of the elongation percentage shown in FIG. 4, the force to stretch the recording medium P1 toward the both sides in the delivery direction acts on the recording medium P1, but the thickness of the surface layer at the region (region shown by X) through which the recording medium P2 passes remains constant in the widthwise direction. Therefore, the force to stretch the recording medium P2 toward the both sides in the delivery direction does not act on the recording medium P2. Accordingly, the force to suppress generation of wrinkling of paper sheets acts on the recording medium P1, whereas the force to suppress generation of wrinkling of paper sheets does not act on the recording medium P2.

As shown above, the fixing device of an exemplary embodiment of the invention may have a profile of a thickness of a surface layer in which the force to suppress generation of wrinkling of paper sheets selectively acts on a recording medium of a specified size, as is the case of FIG. 4.

For example, when the recording medium P1 is a recording medium susceptible to wrinkling of paper sheets such as a paper sheet of A4 or A3 size, while the recording medium P2 is a recording medium being small in size and thus rarely generates wrinkling of paper sheets such as a postcard paper, a fixing device having a configuration of the exemplary embodiment having an elongation percentage profile whereby a force that can suppress wrinkling of a sheet is selectively applied only to a recording medium having a particular size can be utilized.

There may be the cases where wrinkle on a sheet cannot be prevented due to the difficulty in acting the force to stretch the recording medium toward the both sides in the delivery direction, when the degree of the variation in the thickness of the surface layer in the widthwise direction is relatively low against the size of the recording medium passing through the contact portion.

The size in the widthwise direction of the fixing device used in the fixing apparatus also depends on whether an image forming apparatus equipped with the fixing apparatus is a large machine generally for use in an office or the like where A3- or B5-size paper sheets are also printed in addition to A4-size paper sheets, or a small machine generally for use at home where postcard papers are also printed in addition to A4- or B5-size paper sheets.

When such situations are taken into consideration, in the case of a fixing device capable of longitudinally feeding mainly A3 sheets, including at the maximum A3+ size sheets, that is, in the case where the length of the surface layer in a widthwise direction is 320 mm to 360 mm, an absolute value of the difference between the thickness of the surface layer at a center portion of a surface layer with respect to the thickness of the surface layer at positions distanced by 160 mm in the widthwise direction from the center portion toward the both end portion sides is preferably in the range of about 10 μm to about 30 μm.

When the absolute value of the difference between the thickness of the surface layer at a center portion of a surface layer with respect to the thickness of the surface layer at positions distanced by 160 mm is less than about 10 μm, in some cases, it may become difficult to suppress wrinkling of the sheet. On the other hand, when the absolute value of the difference between the thickness of the surface layer at a center portion of a surface layer with respect to the thickness of the surface layer at positions distanced by 160 mm exceeds about 30 μm, since the force by which the recording medium is drawn toward a direction perpendicular to the conveyance direction thereof becomes too strong, in some cases, wrinkles giving a corrugated feeling are generated on the sheet.

On the other hand, in the case of a fixing device capable of longitudinally feeding mainly A4 sheets, that is, in the case where the length of the surface layer in a widthwise direction is 220 mm to 250 mm, an absolute value of the difference between the thickness of the surface layer at a center portion of a surface layer with respect to the thickness of the surface layer at positions distanced by 110 mm in the widthwise direction from the center portion toward the both end portion sides is preferably in the range of about 10 μm to about 30 μm.

When the absolute value of the difference between the thickness of the surface layer at a center portion of a surface layer with respect to the thickness of the surface layer at positions distanced by 110 mm is less than about 10 μm, in some cases, it may become difficult to suppress wrinkling of the sheet. On the other hand, when the absolute value of the difference between the thickness of the surface layer at a center portion of a surface layer with respect to the thickness of the surface layer at positions distanced by 160 mm exceeds about 30 μm, since the force by which the recording medium is drawn toward a direction perpendicular to the conveyance direction thereof becomes too strong, in some cases, wrinkles giving a corrugated feeling are generated on the sheet.

As described above, a thickness of a surface layer is varied along the widthwise direction in a fixing device that adopts the first method of controlling the elongation percentage. The maximum value of the thickness of a surface layer in the widthwise direction is preferably about 50 μm or less. When the maximum value exceeds about 50 μm, the hardness of the surface of the surface layer becomes excessively high, causing a grainy feeling to an image in some cases. On the other hand, the minimum value of the thickness of the surface layer in the widthwise direction is preferably about 20 μm or more. When the minimum value is less than about 20 μm, since the thickness of the surface layer is too low, the surface of the surface layer tends to elongate excessively; accordingly, when the fixing device is used over a long period, in some cases, scratch or wrinkles are generated on the surface of the surface layer, resulting in insufficient durability.

Constituent Material for Fixing device

The material constituting each member in the fixing device of the exemplary embodiment of the invention is now described in more detail with respect to the base material, the elastic layer and the surface layer (releasing layer).

Support

When the fixing device of the first embodiment is a roll-shaped device (hereinafter referred to sometimes as a "fixing roll"), known base materials for forming a fixing roll can be used for a cylindrical base material that constitute the fixing device, which can be selected from cylindrical tubes (cylindrical cores) composed of a metal having excellent electrical conductivity such as aluminum, copper or nickel, an alloy such as stainless steel or nickel alloy, ceramics, or the like. The outer diameter or the thickness of the wall thereof can be selected depending on the purposes.

For example, the outer diameter can be determined on the basis of the desired width of a contact portion for use in a fixing apparatus. Further, when the fixing roll is used as a heating device, it is desired from the viewpoint of reduction in the warm-up time of the heating member that the wall thickness of the cylindrical core has a minimum thickness in such a range as to be durable to suppress the strength applied onto the contact portion when used in the fixing apparatus.

In preparation of the fixing roll, the outer periphery surface of the base material may be subjected to various surface treatments in order to improve adherence to a layer formed on the outer periphery surface of the base material. The surface treatment is not particularly limited, and examples thereof include a degreasing treatment with an organic solvent, a surface roughening treatment with sandblasting, a primer treatment and the like.

When the fixing device in the exemplary embodiment of the invention is an endless belt-shaped device (hereinafter referred to sometimes as a "fixing belt" or an "endless belt"), the fixing device may be formed by any material as long as the material has a strength suitable for training around a support roll or a pressing roll onto which the endless belt is stretched, and examples thereof include a polymer film, metal film, ceramics film, glass fiber film or a composite film obtained by combining two or more thereof.

Examples of the polymer films include sheet-shaped or cloth-shaped products of polyesters such as polyethylene terephthalate, polycarbonates, polyimides, fluorine-based polymers such as polyvinyl fluoride and polytetrafluoroethylene, polyamides such as nylon, polystyrenes, polyacryls, polyethylenes, polypropylenes, modified celluloses such as cellulose polyacetates, polysulfones, polyxylylenes and polyacetals. Further, polymer complex compounds can also be used, which obtained by laminating a general-purpose polymer sheet with a layer of a heat-resisting resin such as a fluorine polymer, a silicone polymer or a crosslinked polymer. Among these, an endless belt being composed of a heat-resisting resin is preferable.

The polymer film may form a composite with a heat-resisting layer made of metal, ceramics or the like. A thermal conductivity improving agent such as granular, acicular or fibrous type of carbon black, graphite, alumina, silicone, carbide, boron nitride may be added to the polymer film. Additives such as an electrical conductivity-imparting agent, antistatic agent, release agent and reinforcing agent may also be added to or applied inside the polymer film or onto the surface thereof, as necessary.

In addition to the polymer film described above, it is possible to employ, for example, paper such as condenser paper, glassine paper or the like, ceramics film, cloth-shaped glass fiber film formed from glass fiber, and metal film such as stainless steel film, nickel film etc.

Elastic Layer

An elastic material formulating the elastic layer of the fixing device can be exemplified by silicone rubber and fluorine rubber, and is preferably be selected from elastic materials having excellent electrical conductivity.

Examples of the silicone rubber include vinyl methyl silicone rubber, methyl silicone rubber, phenyl methyl silicone rubber, fluorosilicone rubber and the like. Examples of the fluorine rubber include vinylidene fluoride rubber, ethylene tetrafluoride/propylene rubber, ethylene tetrafluoride/perfluoromethyl vinyl ether rubber, phosphazene rubber, fluoropolyether, and other fluorine rubbers. These materials can be used alone, or two or more thereof may be used in combination.

It is preferable that the elastic layer has a hardness of about A10/S to about A50/S in terms of the type A durometer hardness defined in ISO 48 (1994), ISO 7619-1 (2004) and ISO 7619-2 (2004), as well as is excellent in heat resistance, compression set and mechanical strength. In view of these, the elastic layer is preferably formed by using an addition-polymerizable silicone rubber which is in a form of a liquid.

In addition to the elastic materials, various kinds of inorganic or organic fillers can be used in the elastic layer.

Examples of the inorganic fillers include carbon black, titanium oxide, silica, silicon carbide, talc, mica, kaolin, iron oxide, calcium carbonate, calcium silicate, magnesium oxide, graphite, silicon nitride, boron nitride, iron oxide, aluminum oxide, and magnesium carbonate. Examples of the organic fillers include polyimide, polyamide imide, polyether sulfone, polyphenylene sulfide. As a special elastic material, PTFE (polytetrafluoroethylene) can also be used as a fluororesin.

Surface Layer (Releasing Layer)

A surface layer is formed on the surface of the elastic layer Prior to the formation of the surface layer, a primer layer may be applied onto the surface of a device onto which the surface layer is formed, in order to improve adhesion between the surface layer and a layer arranged on the surface layer at the side of the support.

Examples of the materials used for forming the primer layer include primers such as 902YL (trade name, manufactured by Du Pont-Mitsui Fluorochemicals, Co., Ltd.), PRM067(trade name, manufactured by Du Pont-Mitsui Fluorochemicals, Co., Ltd.), and the like. The thickness of the primer layer is preferably in a range of about 0.05 μm to about 2.0 μm, and is more preferably in a range of about 0.1 μm to about 0.5 μm.

The surface layer is composed of a fluorine-containing material, which is exemplified by a fluorine material such as a fluororesin or a fluorine rubber. The fluorine-containing material may further contain other additives such as a filler as necessary. The surface layer preferably contains a fluororesin as a main component thereof. Namely, the content of the fluororesin in the fluorine-containing solid material is preferably in the range of about 95% by weight to about 100% by weight. Further, the fluororesin is particularly preferably used in the surface layer when the fixing device has an elastic layer, since the fluororesin is not an elastic material.

Preferable examples of the fluororesin include a tetrafluoroethylene perfluoroalkyl vinyl ether copolymer (hereinafter, in some cases, referred to as "PFA"), that is a copolymer of tetrafluoroethylene and perfluoroalkyl vinyl ether, in consideration of their excellent flexibility as well as their durability to a calcining temperature applied thereto to form the surface layer when silicon rubber is used as the elastic layer.

When a surface layer is formed with PFA by means of an inkjet method described below, a PFA dispersion liquid in which a PFA is dispersed in a solvent is prepared.

In the PFA dispersion liquid that is used to form a surface layer, two kinds of PFA particles different in average particle diameter are preferably included. Specifically, a first PFA particle having an average particle diameter of about 0.1 μm to about 1 μm, and a second PFA particle having an average particle diameter of about 2 μm to about 7 μm are preferably included. The average particle diameter of the first PFA particle is preferably in a range of about 0.3 μm to about 0.8 μm, and the average particle diameter of the second PFA particle is preferably in a range of about 04 μm to about 6 μm.

When the average particle diameter of the first PFA particle is smaller than about 0.1 μm, the viscosity of the PFA dispersion liquid is increased so as to be difficult in some cases to apply an inkjet method to form the surface layer. When the average particle diameter is larger than about 1 μm, the surface layer formed becomes brittle.

Furthermore, when the average particle diameter of the second PFA particle is smaller than about 2 μm mudcracking occurs, in some cases, on the surface layer formed, and, when the average particle diameter thereof is larger than about 7 μm, since forming a surface layer of large film thickness becomes difficult, accordingly, when a fixing device where the first method of controlling the elongation percentage is adopted is being prepared, the elongation percentage of the surface of the surface layer cannot be controlled to the desired value by making use of a variation along the widthwise direction of the thickness of a surface layer, in some cases, resulting in difficulty in suppressing sheets from wrinkling. In addition, since the surface of the surface layer becomes coarse, in some cases, the glossiness of an image formed by use of a fixing device provided with such a fixing device is deteriorated.

In the exemplary embodiment of the invention, the "average particle diameter" refers to a volume-average particle diameter unless otherwise specified. The volume-average particle diameter shown hereinafter can be measured by a laser Doppler heterodyne particle size distribution meter (trade name: MICROTRAC-UPA 150, manufactured by Nikkiso Co., Ltd.). The volume-average particle diameter is specifically determined as a particle diameter corresponding to 50% accumulation in terms of the volume obtained by drawing a cumulative distribution from the particle diameter of smaller side.

Furthermore, a blending ratio of the first PFA particle and the second PFA particle (the first PFA particles/second PFA particles) by mass ratio is preferably in the range of about 10/90 to about 90/10 and more preferably in the range of about 30/70 to about 80/20.

In the case of the blending ratio (the first PFA particles/second PFA particlse) being smaller than about 10/90, when the first method of controlling the elongation percentage is being adopted to form a fixing device, the elongation percentage of a surface of the surface layer cannot be controlled to a desired value by making use of a variation of the thickness of a surface layer in a widthwise direction, in some cases, resulting in difficulty in suppressing sheets from wrinkling. In addition, since the surface of the surface layer becomes coarse, in some cases, the glossiness of an image formed by use of a fixing device provided with the fixing device may be deteriorated. Furthermore, when the blending ratio (the first PFA particles/second PFA particles) is larger than about 10/90, in some cases, mud cracking may be caused.

In addition to the first and the second PFA particles, various additives such as a filler may be dispersed in the PFA dispersion, as necessary. Examples of the solvent include water and alcohols such as methanol, ethanol or i-propyl alcohol.

In addition to the fluorine-containing material such as a fluororesin or a fluorine rubber, various additives such as a filler may be contained in the surface layer if necessary.

The filler which can be contained in the surface layer is preferably at least one selected from the group consisting of metal oxide particles, silicate minerals, carbon black, nitride compounds and mica.

Among these, the filler which can be contained in the surface layer is more preferably at least one selected from the group consisting of BaSO4, zeolite, silicon oxide, tin oxide, copper oxide, iron oxide, zirconium oxide, ITO (indium oxide doped with tin), silicon nitride, boron nitride, titanium nitride and mica, and is still more preferably at least one selected from the group consisting of BaSO4, zeolite and mica. BaSO4 or zeolite is particularly preferable as the filler, and BaSO4 is most preferable as the filler.

The compounding ratio of the filler is not particularly limited, but when a fluororesin is used as the fluorine-containing material, the compounding ratio thereof is preferably about 1 part by weight or more and about 30 parts by weight or less, and is more preferably about 1 part by weight or more and about 20 parts by weight or less, based on 100 pars by weight of the fluororesin.

When the compounding ratio of the filler is smaller than about 1 part by weight based on 100 parts by weight of fluororesin, releasability of toners or a recording medium may become highly excellent due to a high degree of releasability of the fluororesin, whereas abrasion resistance may tend to be deteriorated, and thus abrasion or defects on the surface of the surface layer may easily occur to cause troubles in the fixing apparatus in some cases.

On the other hand, when the compounding ratio of the filler is greater than about 30 parts by weight based on 100 parts by weight of fluororesin, the state of the filler being uniformly dispersed in the surface layer may hardly be obtained, unevenness in the thickness of the surface layer may be caused and the high degree of releasability of the fluororesin may be deteriorated to cause toner offset. Further, the surface of the surface layer may be roughened, lowering the glossiness of an image formed thereon or causing the roughness in the image.

The average particle diameter of the filler is preferably in a range of about 0.1 μm to about 15 μm, and from the viewpoint of preventing generation of sharp protrusions on the surface layer, the average particle diameter of the filler is more preferably in a range of about 1 μm to about 10 μm, and is still more preferably in a range of about 2 μm to about 8 μm.

When the average particle diameter of the filer is smaller than about 0.1 μm, it may become difficult to add and disperse the filler in a dispersion for forming of a surface layer used to form the surface layer by the ink jet method, since the surface area of the powder may become large.

On the other hand, when the above average particle diameter of the filler is greater than about 10 μm, the degree of surface roughness of the surface of the filler-containing surface layer may become too high in some cases. Further, when the above average particle diameter of the filler is greater than about 15 μm, the filler having a large particle diameter may easily form sharp protrusions, which may stick in an image (when printed on both sides of a sheet) and result in generation of white-dotted image defects. Accordingly, when a filler having a particle diameter of greater than about 15 μm is contained in the surface layer, the compounding ratio of the filler having a particle diameter of greater than about 15 μm in the surface layer is preferably about 5% by weight or less, and is more preferably about 3% by weight or less.

Examples of the filler further include electroconductive particles (particles with a volume resistivity of $10^7$ Ωcm or less). Depending on a structure of an image forming apparatus, the surface of the fixing device used in a fixing apparatus mounted in this image forming apparatus may need to be imparted with conductive properties (surface resistivity of $1\times10^4$Ω or less).

In this case, electroconductive particles can be used as the filler compounded in the surface layer. Examples of the electroconductive particles include those referred as the filler compoundable to the surface layer such as the metal oxide particles, silicate minerals, carbon black, nitrogen compound or mica, as well as other particles such as titan oxides.

When electroconductive particles are used as the filler and a fluororesin is used as the fluorine-containing material, the amount of the electroconductive particles used to form the surface layer is preferably in a range of about 1 part by weight to about 10 parts by weight based on 100 parts by weight of the fluororesin from the viewpoint of imparting conductive properties, securing releasability obtained by the fluororesin, and securing the dispersibility of the electroconductive particles.

The surface roughness of the surface of the surface layer (centerline average surface roughness: Ra), while it is not particularly restricted, is preferably about 1.0 μm or less, and is more preferably about 0.5 μm or less. When the surface roughness exceeds about 1.0 μm, in some cases, the graininess of an image may become irregular.

The surface roughness, after measuring the surface roughness at 18 points in total obtained by equally dividing a fixing device into two with respect to a circumferential direction followed by equally dividing the widthwise direction into ten at nine points, is obtained as an average value of measurements at the 18 points.

The surface roughness at each of measurement points can be measured according to Geometrical Product Specifications (GPS) Surface texture: Profile method (ISO 4287 (1997)). Specifically, a stylus surface roughness meter (trade name: SURFCOM 1400A, manufactured by Tokyo Seimitsu Co., Ltd.) is used to measure with a measurement length set at 2.5 mm. For example, measurement conditions at the respective points are set at an evaluation length Ln=2.5 mm, a reference length L=0.8 mm and a cutoff value=0.8 mm.

Method of Producing Fixing Device

Next, a method of producing a fixing device of the exemplary embodiment will be described. The method of producing the fixing device of the exemplary embodiment particularly preferably include utilization of an inkjet method to form the surface layer.

In this case, the fixing device is produced by undergoing at least forming a coated film, and, in the forming a coated film, a liquid droplet discharge head that has a nozzle surface on which at least two nozzles for ejecting a liquid droplet are disposed is disposed such that the nozzle surface faces the outer peripheral surface of a cylindrical support configured from a cylindrical base material and an elastic layer formed on the base material, and while the liquid droplet discharge head moves relatively with respect to the cylindrical support at least in one direction selected from a widthwise direction or a peripheral direction of the cylindrical support, the liquid droplet discharge head ejects a dispersion liquid for forming a surface layer from the nozzle surface on the outer peripheral surface of the cylindrical support to form the coated film.

Here, when a fixing device where the first method of controlling the elongation percentage is adopted is prepared, a dispersion liquid for forming the surface layer is ejected from a nozzle surface of a liquid droplet discharge head onto an outer peripheral surface of a cylindrical support so that a total amount of solid contents contained in the dispersion liquid for forming the surface layer, which is applied (impacted) per unit area of the outer peripheral surface of the cylindrical support, decreases in the widthwise direction of the cylindrical support from the center portion thereof toward both end portions.

Usually, in many cases, one kind of the dispersion liquid for forming a surface layer is used; accordingly, in this case, the amount of solid contents in the dispersion liquid is constant. As the result, in this case, the dispersion liquid for forming the surface layer is ejected from the nozzle surface of a liquid droplet discharge head onto the outer peripheral surface of the cylindrical support so that the total amount of the dispersion liquid for forming the surface layer, which is applied (impacted) per unit area of the outer peripheral surface of the cylindrical support, decreases in a widthwise direction of the cylindrical support from a center portion toward both end portions.

Thereby, a fixing device in which the thickness of the surface layer in the widthwise direction decreases from the center portion toward both end portions can be prepared. The total amount of solid contents contained in the dispersion liquid for forming the surface layer (the total amount of dispersion liquid when the amount of solid content in any kinds of dispersion liquid are constant) which is ejected per unit area of the outer peripheral surface of the cylindrical support in a widthwise direction of the cylindrical support is selected so as to be proportionate in a widthwise direction to the thickness of the surface layer.

In the following, the method of producing the fixing device will be described in more detail.

First, in order to produce a fixing device of the exemplary embodiment of the invention, a cylindrical support is prepared for forming the surface layer by use of an inkjet method. A primer may be applied in advance on an outer peripheral surface of the cylindrical support.

The cylindrical support that is used to form the surface layer can be prepared by using a producing method similar to that for forming a fixing device which is in a state before a conventionally-known surface layer is prepared thereto.

As indicated in the above, the surface layer of the fixing device is formed at least through forming a coating film by coating the outer periphery of the cylindrical support with a coating liquid for forming the surface layer by an ink jet method. Usually, the formation the coating film is followed by drying the coating film as necessary, and finished by baking the resulting the semidried- or dried-coating film, so as to form the surface layer.

The treatment time length and treatment temperature in the drying and baking can be selected depending on the formulation of the coating liquid for forming a surface layer to be used. When a PFA dispersion is used as the coating liquid, the treatment time length in the drying can be, for example, in the range of about 10 minutes to about 30 minute's, and the drying temperature can be in the range of about 80° C. to about 150° C., the treatment time in the baking can be in the range of about 10 minutes to about 30 minutes, and the baking temperature can be in the range of about 280° C. to about 330° C.

In the forming of a coated film, any method for forming a coated film by coating a liquid on a surface of a solid device can be used in place of the inkjet method, such as a dip coating method, a ring slot die method, a process of continuously flowing a liquid from a nozzle to spirally form a film, or a spray coating method. However, for the following reasons, the inkjet method is particularly preferably used herein.

Firstly, in the dip coating method, a coated film can be made thicker when a coating speed is raised. Therefore, a surface layer having a film thickness distribution in a widthwise direction of a cylindrical support can be readily formed by controlling the coating speed. However, since this is a process including dipping a cylindrical support in a bath filled with a dispersion liquid for forming a surface layer and moving it upward in a vertical direction to form a coated film, there is a fundamental problem of a flow of the coated film owing to gravity, that is so-called coating run. Accordingly, a desired film thickness distribution from top and bottom end portions of the coated film cannot be made, and it is difficult to make the difference of the film thicknesses between the top and bottom end portions (that is, both end portions in a widthwise direction of the cylindrical support) small. Furthermore, since there are differences in the dipping times between top and bottom ends of the cylindrical support, due to differences in exposure to solvent and the like a difference of film thickness between the two end portions of the cylindrical support is generated.

In the ring slot die method, although an influence of the solvent exposure is smaller than that in the dip coating method, there is a problem common to that of dip coating methods in that coating run is caused because the coating process is in the vertical direction. Accordingly, it is impossible to form the desired film thickness distribution up to the top and bottom end portions of a coated film and difficult to make the difference of film thicknesses between the top and bottom end portions small.

According to a process for spirally forming a film by continuously flowing a liquid flow from a nozzle, which is disclosed in JP-A No. 3-193161, when a wavelength is lowered to improve the leveling properties, the wet film thickness becomes larger. That is, a thin film cannot be obtained by use of a coating liquid having the same concentration.

In addition, when a solid content concentration of the wet film is lowered to make a film thickness after drying smaller, after spiral flows converge, the leveling becomes excessive and coating run of the coated film tends to occur.

Accordingly, in dip coating methods, ring slot die methods and methods of continuously flowing a liquid flow from a nozzle to spirally form a film, variation of the thickness of the surface layer in the widthwise direction becomes unavoidably asymmetrical, with a center portion as a reference. In addition, since the thickness of the surface layer in the widthwise direction cannot be exactly controlled, there tends to be varying performance in suppressing wrinkling between fixing devices.

Furthermore, when a fixing roll is prepared, a process where after a fixing roll that has a constant thickness of a surface layer in a widthwise direction is prepared a surface of a surface layer is polished to control a thickness of the surface layer in a widthwise direction can be cited. However, according to such a process, the thickness of the surface layer cannot be exactly controlled in the widthwise direction; accordingly, the dimensional accuracy fluctuates between fixing devices, resulting in readily generating fluctuations in the performance of suppressing sheets from wrinkling.

On the other hand, in spray coating methods, a liquid droplet is ejected from a nozzle of a spray gun to spray onto a cylindrical support; accordingly, when the spraying amount of the liquid ejected from the nozzle of the spray gun is controlled, a film thickness distribution can be formed.

However, in comparison with an inkjet method, the direction of flight of liquid droplets ejected from the nozzle of the spray gun is very broad; accordingly, not only the impacting positions of the liquid droplets that impact on the surface of the cylindrical support lack controllability, but also, because the liquid droplet diameter distribution is broad and the central particle diameter is relatively large, the desired film thickness cannot be obtained. Accordingly, the dimensional accuracy fluctuates between fixing devices, resulting in ready generation of fluctuations in the performance of suppressing wrinkling of sheets.

Furthermore, in spray coating methods, it is very difficult to form a thick film with a thickness of 40 μm or more and material usage efficiency is bad. Accordingly, except particular cases where a base material made of a circular cylinder tube with an outer diameter exceeding about 10 mm, or an endless belt-shaped base material with a peripheral length of exceeding about 40 mm, is used, it is difficult to apply a spray coating method in the preparation of the fixing device of the exemplary embodiment.

On the other hand, as compared with a spray gun used in the spray coating method, the liquid droplet discharging head used as a liquid droplet eject means in the ink jet method has the advantages such as: (1) straightness of direction and high accuracy of position of the ejected liquid droplets; and (2) constant diameter of the liquid droplets. Unlike a spray gun having one nozzle (eject spout), the liquid droplet discharging head has two or more nozzles arranged on a nozzle face, and the diameter of the nozzles is smaller than that of the spray gun and is usually in the range of about 20 μm to about 30 μm. Further, the liquid droplets are ejected from the nozzles in substantially parallel with the nozzle axis (in the range of about 0° to about 5° relative to the nozzle axis) unless force, such as wind blown across the nozzle axis, is applied to the liquid droplets ejected from the nozzles.

Accordingly, when an inkjet method is used to prepare a fixing device, in comparison with cases where other coating processes are used, the surface layer can be formed with very high thickness accuracy in the widthwise direction and in the circumferential direction, and the variation in performance of suppressing wrinkling of sheets can be readily made small between fixing devices.

Furthermore, unlike spray coating methods, the thickness of the surface layer formed is not restricted and the surface layer having a thickness of about 40 μm or more that is difficult to prepare by means of the spray coating method can be formed at any position in the widthwise direction. In addition to the above, the size of the base material that is used to prepare the fixing device is not particularly restricted; that is, a fixing device can be readily prepared with a base material made of a circular cylinder tube having an outer diameter of about 10 mm or less or an endless belt-shaped base material having a circumferential length of about 40 mm or less. A lower limit value of an outer diameter of a base material made of a circular cylinder tube is, though not particularly restricted, about 15 mm or more in practice. Furthermore, a lower limit value of a circumferential length of the endless belt-shaped base material is, though not particularly restricted, about 50 mm or more in practice.

Further, as a secondary effect of the ink jet system, the amount of vaporized solvent or the amount of wasted coating liquid can be reduced as compared with conventional dipping coating methods. Further, there is no need of wiping the bottom part of the fixing device, that is required in the dipping coating method, since coating in the ink jet system is selectively performed onto a specified region.

The liquid droplets are ejected from the liquid droplet discharging head in, the ink jet system and reach the cylindrical support, while increasing the solid content thereof during flying. Accordingly, the liquid droplets coalesce with each other to form a liquid film and are leveled on the surface of the cylindrical support, then dried and solidified to form a dry coating film. The index L that shows the degree of tendency of leveling is expressed as a function of the surface tension of a coating film, thickness of a wet film, viscosity and wavelength. Among these, wavelength contributes most significantly to leveling, and when the resolution upon reaching the surface is higher, leveling properties are more improved.

Accordingly, the surface layer having a composition in the widthwise direction being regulated with high accuracy can be formed by using the ink jet method capable of ejecting liquid droplets having small diameters with less variation onto the desired positions.

In the ejecting system in the ink jet method, commonly-used systems such as continuous systems or intermittent systems (for example, piezoelectric element type systems, thermal type systems or electrostatic type systems) can be used.

Among these, continuous or intermittent ejecting system utilizing the piezoelectric system are preferable, and the piezoelectric intermittent system is more preferable from the viewpoint of forming a thin film and of reducing the amount of waste liquid.

FIGS. 5 to 9 are schematic views showing the method of forming a surface layer on the surface of a cylindrical support (cylindrical support having a round section) by an ink jet method using a scanning liquid droplet discharging head capable of scanning in the axial direction of the cylindrical support. In the invention, however, the method of forming the surface layer is not limited thereto.

The "scanning" is a system of coating with liquid droplets ejected from a scanning liquid droplet discharging head that scans in parallel with the widthwise direction of the tubular support (or in parallel with the axial direction when the support is cylindrical).

Figure 5:
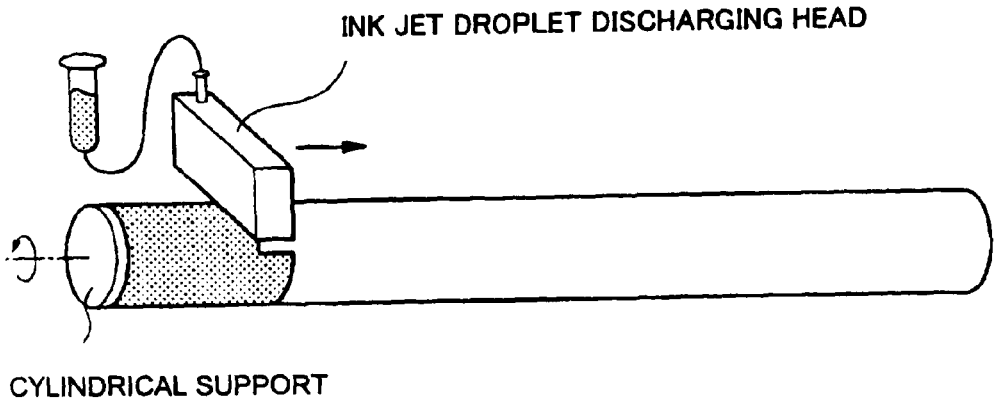
FIG. 5 is a schematic view showing an example of the method of forming a surface layer on the surface of a cylindrical support by an ink jet method using a scanning liquid droplet discharging head capable of scanning in the axial direction of the cylindrical support.

FIG. 5 is an example of an ink jet system of using a liquid droplet discharging head used in a common ink jet printer, in which the liquid discharging head having plural nozzles in the longitudinal direction. In FIG. 5, a simple syringe as a source for supplying a coating liquid is also connected to the liquid droplet discharging head.

When the cylindrical support is arranged with its axis directed horizontally, usually the cylindrical support is rotated and simultaneously coated with liquid droplets. The resolution of the ejecting that influences the qualities of a coating film is determined by the direction of scanning and the angle of the nozzle array.

Figure 11:
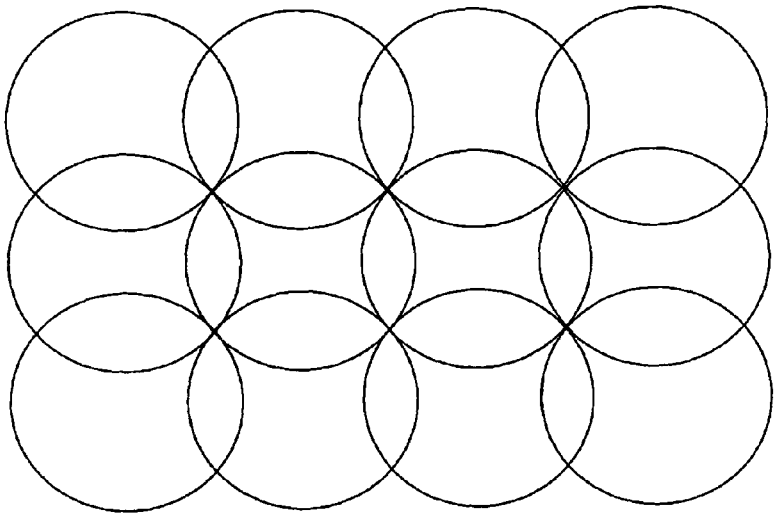
FIG. 11 is a schematic view showing an example of the distribution of liquid droplets ejected from a liquid droplet ejecting unit and landed on the surface of the cylindrical support.

As shown in FIG. 11, the resolution of ejecting of liquid droplets (the number of drops of a coating liquid in 1 inch square) is preferably regulated such that the liquid droplets, having landed on the surface of an object, spread to contact with adjacent liquid droplets and eventually form a coating film. The application may be conducted in consideration of the surface tension of the cylindrical support, state of spreading of liquid droplets upon reaching the surface, size of the liquid droplets upon ejecting, evaporation speed of the coating solvent that are attributed to the concentration of the solvent and the type of the solvent, and the like. These conditions are determined by the constituents or composition of the material for the coating liquid, or the physical properties of the surface of the cylindrical support to be coated, which are preferably regulated.

Figure 12A:
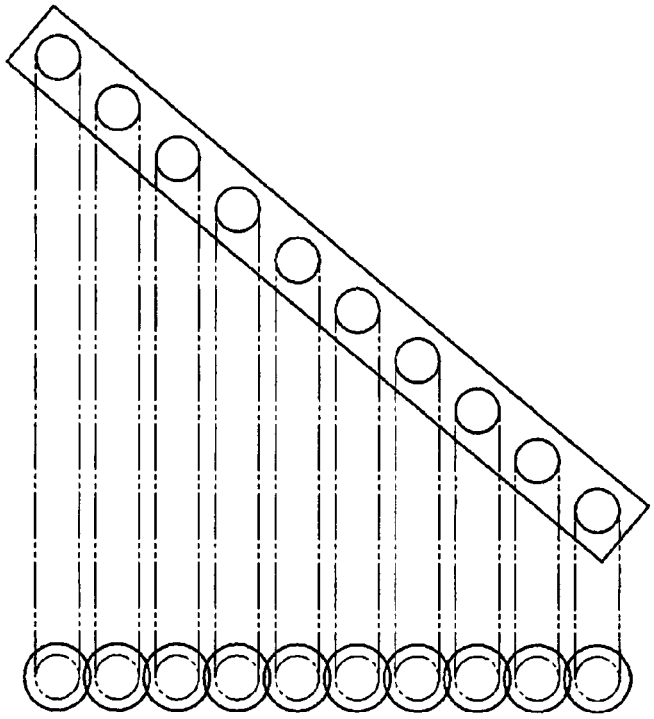
FIG. 12 is a schematic view showing an example of the method of improving apparent resolution used in an example of the method of forming a surface layer.
Figure 12B:
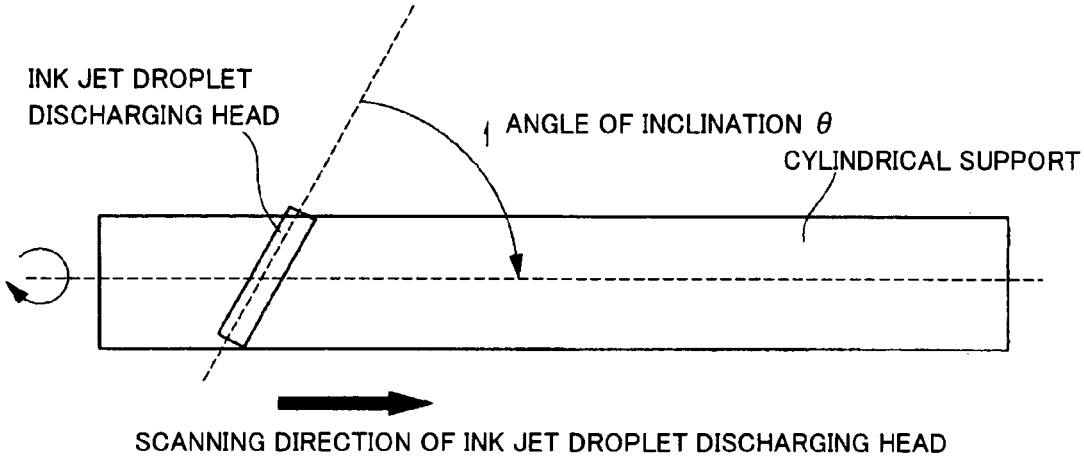

However, as described above, it is difficult to shorten the distance between the nozzles to improve the resolution in the piezoelectric ink jet liquid droplet discharging head. Therefore, in consideration of the distance between the nozzles, it is preferable that the liquid droplet discharging head is arranged in a slanted manner against the axis of the cylindrical support, as shown in FIG. 12A and FIG. 12B, such that the liquid droplets contact with adjacent liquid droplets after being ejected from the nozzles and have reached the surface, as shown in FIG. 11, thereby improving apparent resolution. As shown in FIG. 12A, the diameter of the liquid droplets at the time of ejecting is almost the same as that of the nozzle as indicated by the dashed line, but after reaching the surface of the cylindrical support, the liquid droplets spread as indicated by the solid line, thereby contacting with adjacent liquid droplets to form a layer.

Figure 13:
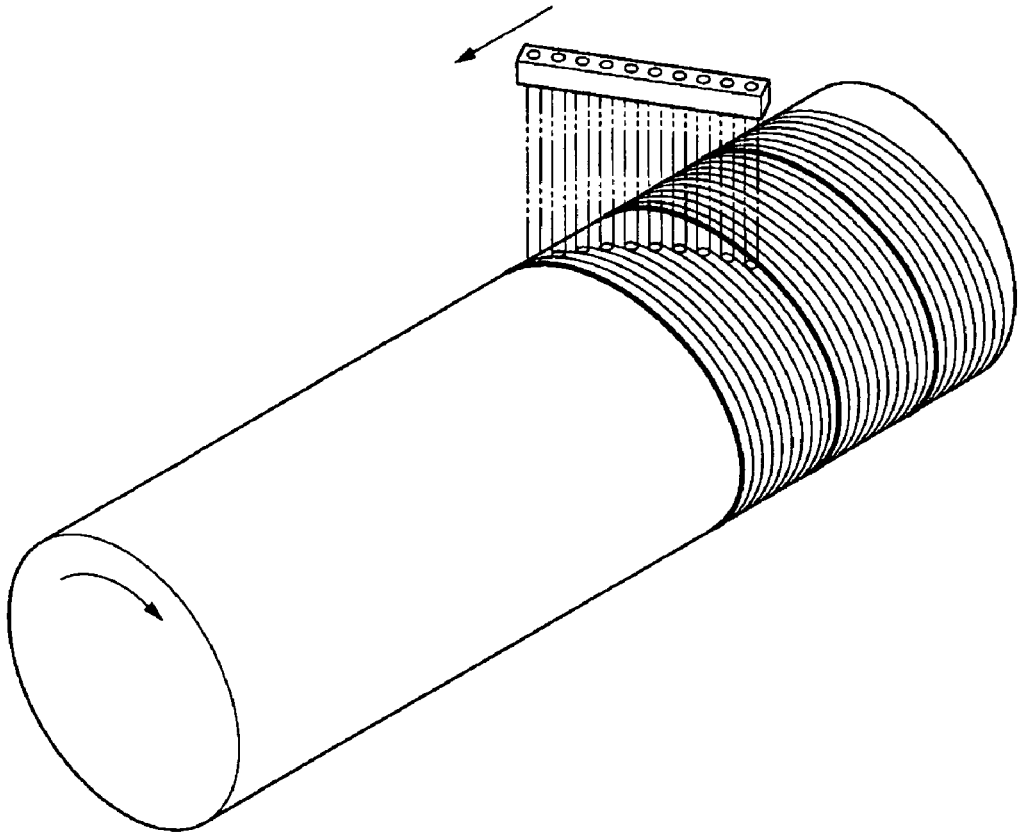
FIG. 13 is a schematic view showing another example of the method of forming a surface layer on the surface of a cylindrical support by an ink jet method using a scanning liquid droplet discharging head capable of scanning in the axial direction of the cylindrical support.

In this state, the cylindrical support is rotated, and a coating liquid is ejected from the nozzles as the liquid droplet discharging head moves horizontally from one end of the cylindrical support to the other end, as shown in FIG. 13. The process is repeated to make the surface layer thicker.

Specifically, the cylindrical support is mounted onto a device capable of horizontally rotating, and the liquid droplet discharging head charged with a surface layer-forming coating liquid is placed in such a manner that the liquid droplets are ejected onto the cylindrical support. It is preferable that the nozzles that do not eject the liquid onto the cylinder is closed, in terms of reducing the amount of waste liquid, since the object onto which the liquid droplets are ejected is in the form of a cylinder having a small diameter.

In the example shown in FIG. 5, a cylindrical support is used as a member to be coated. On the other hand, when a fixing belt is prepared as the fixing device, it is also possible to form a surface layer by training a member to be coated on two rolls, in which the member is in the form of an endless belt and has not been provided with a surface layer, and in which one of these rolls functions as a driving roll, then placing the liquid droplet discharging head to face to the flat area in the outer periphery of the member to be coated.

Figure 6:
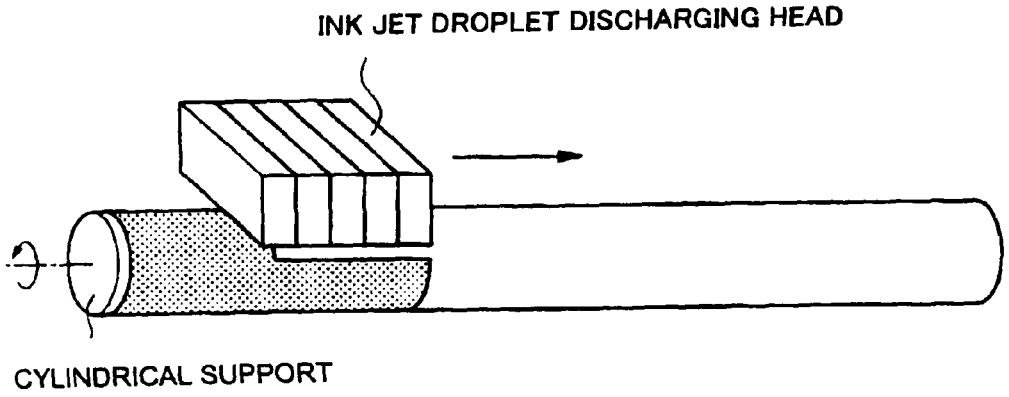
FIG. 6 is a schematic view showing an example of the method of forming a surface layer on the surface of a cylindrical support by an ink jet method using an integrated head, in which plural liquid droplet discharging heads, one of which is shown in FIG. 5, are connected with each other in the axial direction of the cylindrical support and arranged in a matrix manner.

FIG. 6 is a schematic view showing an example of the method of forming a surface layer on the surface of a cylindrical support by an ink jet method using an integrated head, in which plural liquid droplet discharging heads, one of which is shown in FIG. 5, are connected with each other in the axial direction of the cylindrical support and arranged in a matrix manner. In this case, a large amount of liquid droplets can be ejected at the same time from the integrated head and the area to be applied is broadened, thereby enabling high-speed coating. Further, by selecting the jetting nozzles to eject or arranging the nozzles having different sizes in matrix, the amount of the ejected liquid droplets can be easily regulated. In this case, each of the liquid droplet discharging head units constituting the integrated head ejects a single coating liquid.

Figure 7:
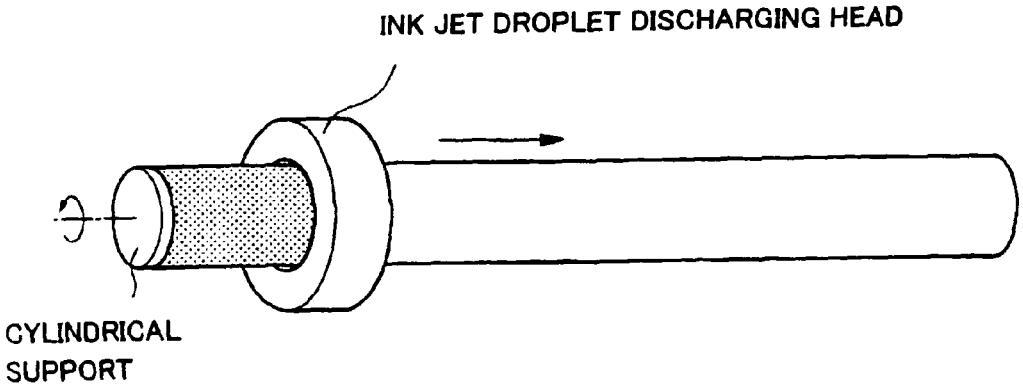
FIG. 7 is a schematic view showing an example of the method of forming a surface layer on the surface of a cylindrical support by an ink jet method using a cylindrical liquid droplet discharging head placed so as to enclose the circumference of the cylindrical support.

FIG. 7 is a schematic view showing an example of the method of forming a surface layer on the surface of a cylindrical support by an ink jet method using a cylindrical liquid droplet discharging head placed so as to enclose the circumference of the cylindrical support. Eject nozzles are usually formed at predetermined intervals in the circumferential direction of the inner periphery of the cylindrical liquid droplet discharging head. By using the cylindrical liquid droplet discharging head, coating thickness unevenness in the circumferential direction can be further reduced and a coating film without distinct spiral stripes can be formed.

Figure 8:
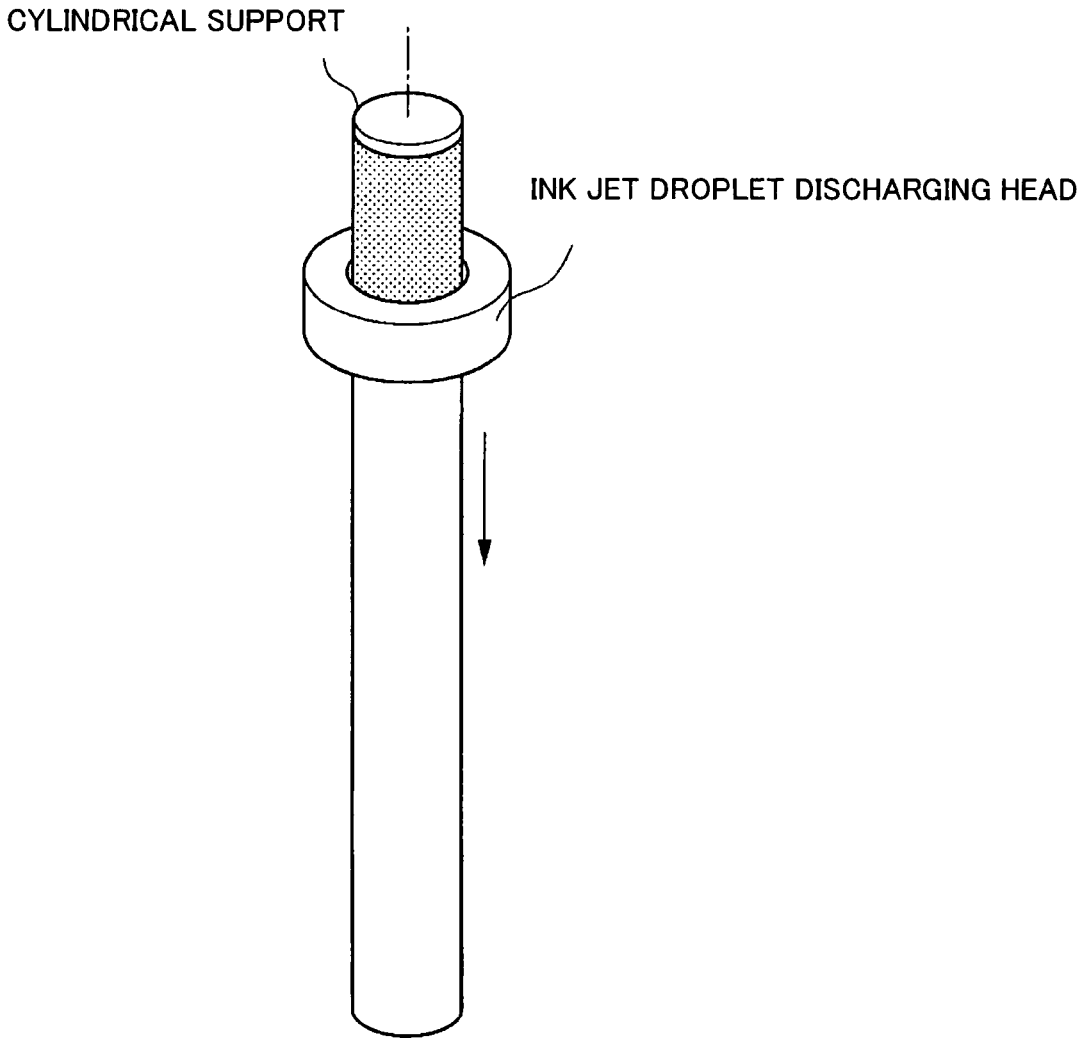
FIG. 8 is a schematic view of the method of forming a surface layer shown in FIG. 7, in which the cylindrical support is placed so that its axis is in a vertical direction.

FIG. 8 is a schematic view of the method of forming a surface layer shown in FIG. 7, in which the cylindrical support is placed so that its axis is in a vertical direction. The vertical direction means not only 90° but also an angle deviated from 90°.

Figure 9:
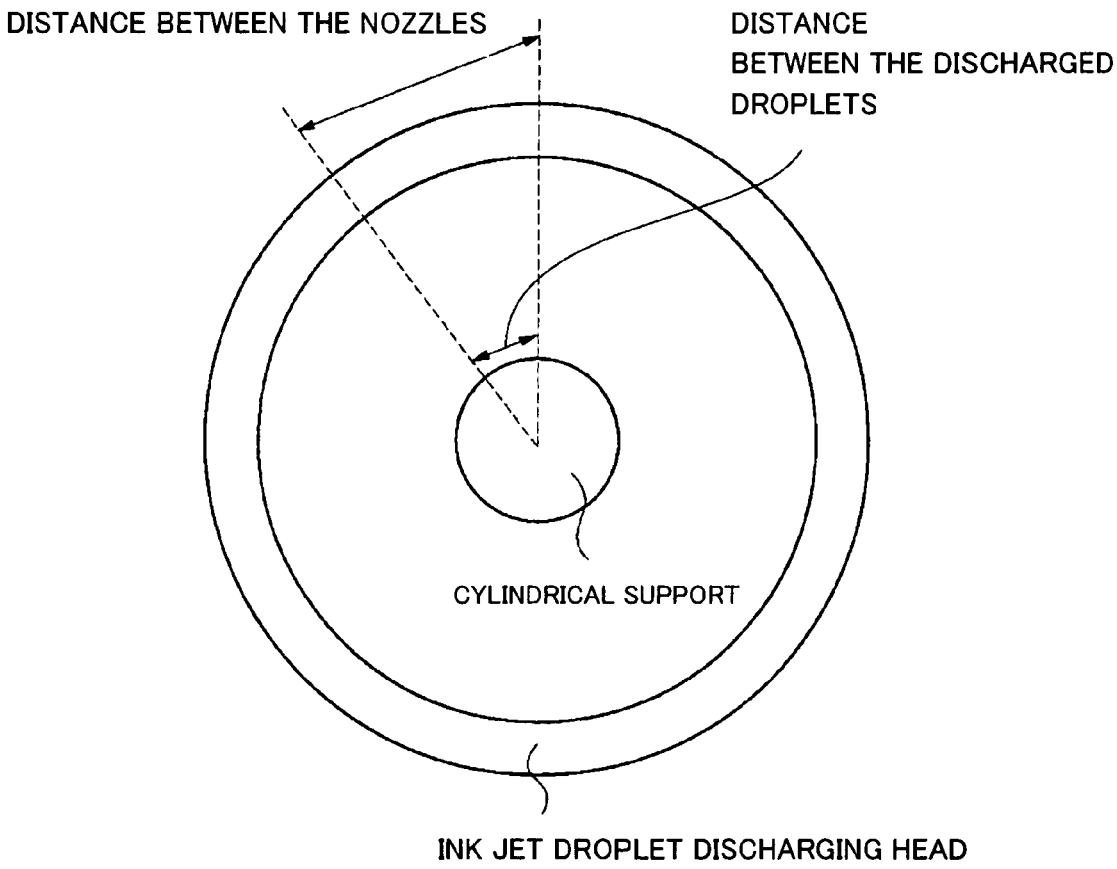
FIG. 9 is a schematic view showing an example a cylindrical liquid droplet discharging head.

In FIGS. 7 and 8, a coating film can be formed without rotating the cylindrical support. In these cases, however, it is not possible to use the method shown in FIGS. 12A and 12B in which the apparent resolution is improved by allowing the rotation axis and the nozzle array to have a certain angle therebetween. In the case of the cylindrical liquid droplet discharging head, however, the distance of the liquid droplets to reach the surface can be shortened by increasing the diameter of the liquid droplet discharging head, thereby improving the resolution on the cylindrical support, as shown in FIG. 9. Therefore, in the case of the piezoelectric liquid droplet discharging head, a high-quality coating film can be formed by using a cylindrical liquid droplet discharging head, although the distance between the nozzles is difficult to shorten in manufacturing.

FIGS. 7 and 8 show the cases where a single cylindrical liquid droplet discharging head is used. In this case, a cylindrical liquid droplet discharging head provided with two or more lines of nozzle groups arranged linearly in the longitudinal direction of the cylindrical liquid droplet discharging head is used, and two or more kinds of coating liquids that are different from each other are respectively ejected from each of the nozzle lines.

Alternatively, two or more cylindrical liquid droplet discharging heads capable of independently scanning in the axial direction of the cylindrical support may be arranged and the coating liquids that are different from each other are respectively ejected from each of the cylindrical liquid droplet discharging heads.

Further, similarly to the case shown in FIG. 6, plural cylindrical liquid droplet discharging heads connected with each other may be arranged in the axial direction of the cylindrical support.

Figure 10:
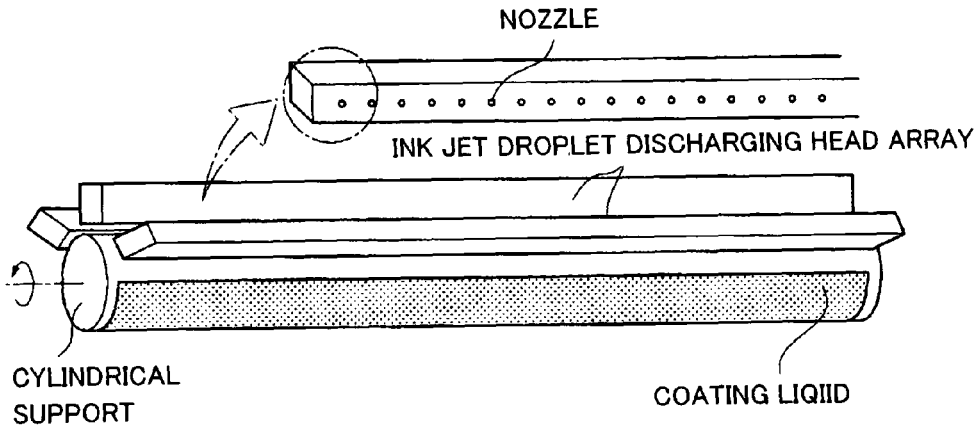
FIG. 10 is a schematic view showing an example of the method of forming a surface layer by an ink jet method in which a liquid droplet discharging head has the width equal to or greater than the length of the axial direction of a cylindrical support, thereby coating the surface of the cylindrical support over the whole length at the same time in the axial direction.

FIG. 10 is a schematic view showing an example of the method of forming a surface layer by an ink jet method in which a liquid droplet discharging head has the width equal to or greater than the length of the axial direction of a cylindrical support, thereby coating the surface of the cylindrical support over the whole length at the same time in the axial direction.

When the cylindrical support is arranged so that the axis thereof is in the horizontal direction as shown in FIG. 10, usually coating is performed as the cylindrical support is rotated. As described above, it is difficult to reduce the distance between the nozzles in the piezoelectric ink jet liquid droplet discharging head, and a resolution with which a high-quality film can be formed is hardly obtained.

As a means to solve this problem, it may be considered to use two or more liquid droplet discharging heads, as shown in FIG. 10, for example. Alternatively, even in a case where a single liquid droplet discharging head is used, a coating film can be continuously formed by slightly scanning in the axial direction to fill the difference between the nozzles.

In the example shown in FIG. 10, a controlled amount of coating liquid is ejected from the nozzle at predetermined position in the longitudinal direction of the liquid droplet discharging head, thereby enabling controlling of the thickness of the surface layer in the widthwise direction of the surface layer.

In the exemplary embodiments of scanning liquid droplet discharge heads shown in FIGS. 5 through 8, a thickness of a surface layer in a widthwise direction can be varied by (1) scanning is performed by moving a liquid droplet discharge head at a constant speed in an axial direction of a cylindrical support with varying an ejecting amount per unit time, or, (2) scanning is performed by moving a liquid droplet discharge head with varying a scanning speed in an axial direction of a cylindrical support while an ejecting amount per unit time is set at a constant value, so that a desired profile of the thickness of the surface layer in the widthwise direction of the surface layer may be obtained.

For example, in the case shown in the (2), when, with an eject amount per unit time maintained at a constant value, a scanning speed is continuously increased from a starting end (one end portion) to a mid point (center portion) and continuously decreased from the mid point to a final end (other end portion), a desired film thickness distribution can be readily obtained.

Furthermore, when for example a continuous liquid droplet discharge head is used, a method where an ejecting direction of liquid droplets is deflected by use of an electric field can be used as well. In this case, when, on approaching near both end portions, an electric field intensity applied to the liquid droplets ejected from the liquid droplet discharge head is increased, and, as approaching a center portion side, an electric field intensity applied to the liquid droplets ejected from the liquid droplet discharge head is decreased, the total amount of liquid droplets impacting on a surface of a cylindrical support can be made small at both end sides and large at a center portion side. Liquid droplets that do not impact on the surface of the cylindrical support are recovered through a gutter.

In a case where an intermittent liquid droplet discharge head is used, an ejecting frequency is set higher on a center portion side than on both end sides. Furthermore, when a pulse voltage is made higher or a time is made longer on a center portion side than on end portion sides, the ejecting amount can be increased. Still further, when nozzle(s) that do not eject at an end portion side, owing to not being imparted with a pulse, are disposed as well, a desired thickness profile can be attained.

Furthermore, in a case where a liquid droplet discharge head shown in FIG. 10 is used, when only one kind of base material is used to coat in production, it is possible to, in advance, vary the sizes of nozzles, that is, to make nozzle diameters relatively smaller on the end portion sides than at the center portion side. Still further, when a plurality of liquid droplet discharge heads are combined to dispose as shown in FIG. 10, the disposition and number of the liquid droplet discharge heads can be set so that a ejecting amount may be small on an end portion.

The viscosity of a coating liquid used in the intermittent liquid droplet discharging head for ink jet is preferably in the range of about 0.8 mPa·s to about 20 mPa·s, and is more preferably in the range of about 1 mPa·s to about 10 mPa·s.

The "viscosity of a coating liquid" in this exemplary embodiment refers to a value determined by an E-type viscometer (trade name: RE550L, standard cone rotor, revolution rate; 60 rpm, manufactured by Toki Sangyo Co., Ltd.) in an environment at 25° C.

The viscosity of the coating liquid can be regulated by selecting the concentration of a solid in the coating liquid or the kind of a solvent of the coating liquid.

When a coating liquid at high concentration, i.e., a coating liquid of high viscosity is used for the purpose of reducing the amount of the solvent released into the air, a continuous-type ink jet liquid droplet discharging head that applies pressure to the coating liquid is preferably used. However, an intermittent-type ink jet liquid droplet discharging head can also be used for a highly viscous material, by providing a heater for heating the coating liquid which is used in a commercially available bar coat printer to reduce viscosity at the ejecting point. Although the range of selection of the coating liquids is limited in this case, an ink jet liquid droplet discharging head of electrostatic and intermittent-type can be applied to a solution with high viscosity.

The amount per liquid droplet to be ejected is preferably in a range of about 1 pl to about 60 pl, is more preferably in a range of about 1.5 pl to about 55 pl, and is still more preferably in a range of about 2.0 pl to about 50 pl. When the amount per liquid droplet is in this range, nozzle clogging hardly occurs and there is also an advantage from the viewpoint of productivity. Further, the concentration of the liquid droplets that reach the surface of the cylindrical support per unit area per unit time can be easily regulated.

In the invention, the amount of a liquid droplet is defined as the one determined by off-line visualization evaluation. The diameter of a liquid droplet is determined by observing an image obtained by flashing LED (light emitting diode) in synchronization with the timing of ejecting to the liquid droplets, by a CCD (charge coupled device) camera. The amount of a liquid droplet can be calculated from the above diameter of a liquid droplet and the density of the coating liquid.

While the method of forming a layer by an ink jet method that has been described here is only for the case of forming a surface layer, the ink jet method can also be applied to formation of other layers such as an elastic layer.

Fixing Apparatus

A fixing apparatus of an exemplary embodiment of the invention includes at least a heating device and a pressing device disposed in contact with the heating device and uses a fixing device of an exemplary embodiment of the invention as at least one of the heating device and the pressing device.

In the fixing apparatus, by passing a recording medium on which an unfixed toner image is formed through the contact portion between the heating device and the pressing device, the unfixed toner image is fixed onto a recording medium.

The heating device is heated by means of a heating unit such as a heater lamp or an electromagnetic induction heating apparatus disposed inside or outside of the heating device. Furthermore, one of the heating device and the pressing device is a fixing device on a drive side, the other device thereof is a fixing device on a following side that follows the fixing device on the drive side, and the fixing device on the drive side is driven by a driving source such as a motor, as needs arise, through a driving force transmission device such as a gear or a shaft. Still further, the contact portion is formed when the heating device and the pressing device are disposed faced in contact, so as to press against each other.

In the fixing apparatus of the exemplary embodiment, the heating device and the pressing device are disposed faced so as to press against each other to form a contact portion. Here, the variation in the widthwise direction of the pressing force applied at the contact portion is preferably within about ±10%, is more preferably within about ±8% and is further preferably within about ±5%.

This is because, in the fixing apparatus of the exemplary embodiment, the difference of the elongation percentages in the widthwise direction of the surface of the surface layer of the fixing device of the exemplary embodiment is made use of to suppress sheets from wrinkling as described above; accordingly, in a fixing device provided with a pair of straight-shaped fixing devices, there is no necessity to provide a distribution in the pressing force in the widthwise direction of the contact portion. As the result, when the pressing force in the widthwise direction of the contact portion is set constant, in comparison with a conventional fixing device in which the pressing force has a distribution in the widthwise direction of the contact portion, in addition to being easy to assemble the fixing device, the variation of performance in suppressing wrinkling of sheets between fixing devices caused by the variation of the pressing force distributions in the widthwise direction of the contact portion may be suppressed as well.

Here, the variation in the widthwise direction of the pressing force applied at the contact portion is measured over the entire width of the contact portion by inserting a sensor sheet into the contact portion by use of a tactile sensor system (manufactured by Nitta Corporation).

When only one of the pair of fixing devices used in the fixing apparatus consists of the fixing device of an exemplary embodiment of the invention, any conventionally-known fixing device can be used as a counterpart fixing device thereof without particular limitation. However, when the counterpart fixing device is a fixing roll, it is particularly preferable that the fixing roll has an outer diameter which is constant in the widthwise direction (the variation in dimension in the widthwise direction is within about ±0.5%). This is because when a fixing roll has a flare shape, i.e., the outer diameter thereof decreases in the direction from the both sides toward the center in the axial direction, an effect of suppressing wrinkling of sheets may be adversely diminished, or because when a fixing roll has a flare shape, variation in the performance of preventing wrinkling of sheets among fixing apparatuses becomes significant, and the cost of the fixing apparatus increases.

Furthermore, when any one of a pair of fixing devices that is used in a fixing apparatus is an endless belt, and a pressing device (pad) is disposed on an inner peripheral surface side of the endless belt so that an outer peripheral surface of the endless belt may be pressed against the fixing device disposed facing the endless belt, the shape in the widthwise direction of the surface (pressing surface) in contact with the inner peripheral surface of the endless belt of the pressing device is not a curved one, but is particularly preferably a flat one. This is because, when the fixing device of the exemplary embodiment is used, wrinkling of sheets may be readily suppressed and fluctuation in the performance of suppressing wrinkling of sheets between fixing apparatuses may be prevented, even without making a curving shape in the widthwise direction of the pressing surface of the pressing device in order to form a distribution in the pressing force in the widthwise direction of the contact portion.

When fixation is performed with the fixing apparatus, a recording medium is passed through the contact portion such that the center in the widthwise direction of the surface layer of the fixing device and the central line of the recording medium substantially conform with each other (i.e., difference in width between the center and central line is in the range of about ±5 mm in the widthwise direction), regardless of its size and shape, or the direction in which the recording medium passes through the contact portion (whether the longer or shorter direction of the recording medium conforms with the widthwise direction of the fixing device). When the central line of the recording medium passing through the contact portion does not substantially conform with the central portion in the widthwise direction of the surface layer of the fixing device of the exemplary embodiment, the wrinkling of sheets may not be suppressed.

In the following, specific examples of fixing apparatuses of exemplary embodiments of the invention will be described with reference to the drawings. However, the invention is not limited to the exemplary embodiments.

Further, in the descriptions of the respective exemplary embodiments shown in the drawings below, though not particularly referred to, a fixing device of the invention is used in at least one of a pair of fixing devices. (However, when a fixing device that does not have an elastic layer is used, the fixing device cannot be a fixing device of an exemplary embodiment of the invention).

Figure 14:
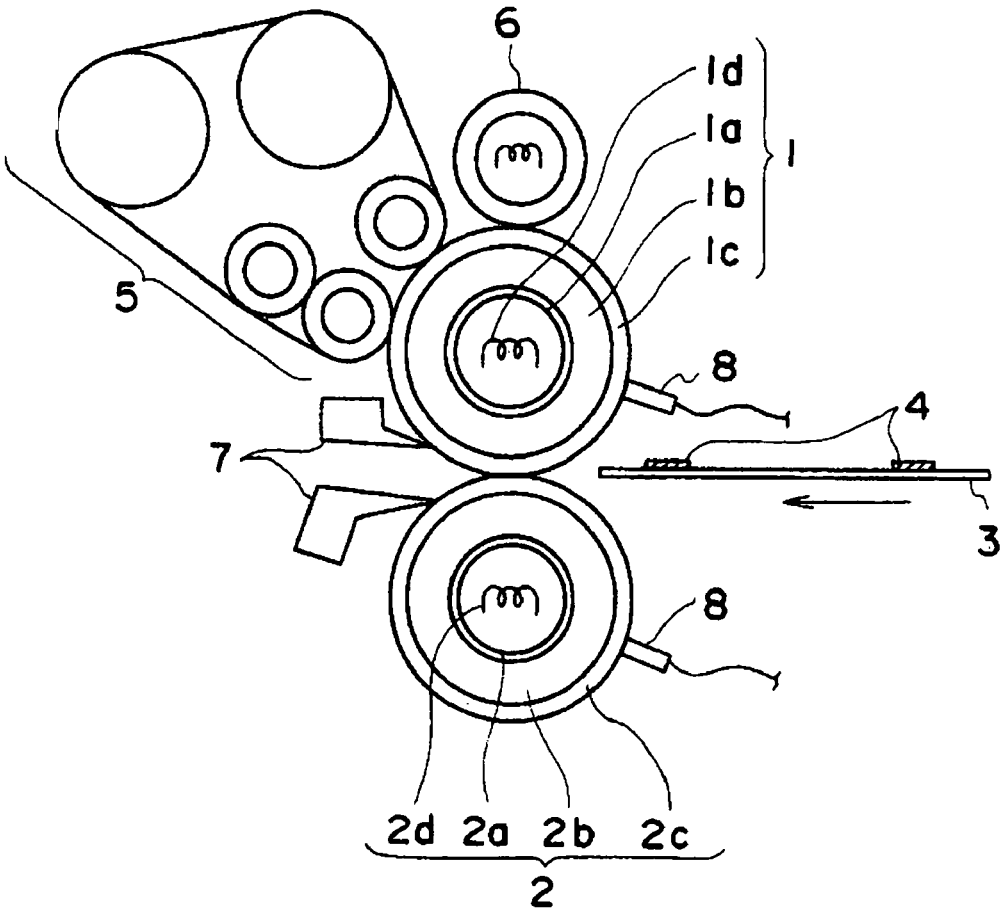
FIG. 14 is a schematic view of a heat roll-type fixing apparatus according to a first exemplary embodiment of the fixing apparatus of the invention.

FIG. 14 is a schematic view of the fixing apparatus according to a first exemplary embodiment of the fixing apparatus of the invention, i.e., a heat roll-type fixing apparatus. In the heat roll-type fixing apparatus shown in FIG. 14, a heat roll 1 and a pressing roll 2, a pair of fixing devices constituting the main part of the fixing apparatus, are arranged so as to face each other and contact with each other to form a contact portion.

The heat roll 1 has an elastic layer 1*b* and a releasing layer 1*c*, the layers being formed in this order on the outer periphery of a cylindrical core 1*a* having a heat source 1*d* such as a heater lamp therein. On the outer periphery of the heat roll 1 is provided a cleaning unit 5 for cleaning the surface of the heat roll 1, an external heating device 6 for supplemental heating of the surface of the heat roll 1, a release nail 7 for releasing a recording medium 3 after fixation, and a temperature sensor 8 for controlling the surface temperature of the heat roll 1.

The pressing roll 2 has an elastic layer 2*b* and releasing layer 2*c*, the layers being formed in this order on the outer periphery of a cylindrical core 2*a* having a heat source 2*d* such as a heater lamp therein. On the outer periphery of the pressing roll 2 is provided the release nail 7 for releasing the recording medium 3 after fixation, and the temperature sensor 8 for controlling the surface temperature of the pressing roll 2.

The recording medium 3 having non-fixed toner image 4 formed thereon is passed through the contact portion formed by the heat roll 1 and pressing roll 2, thereby fixing the non-fixed toner image 4.

Each of the external heating device 6 and the heat source 2*d* in the pressing roll 2 is provided as needed, and thus can be omitted in some cases.

Figure 15:
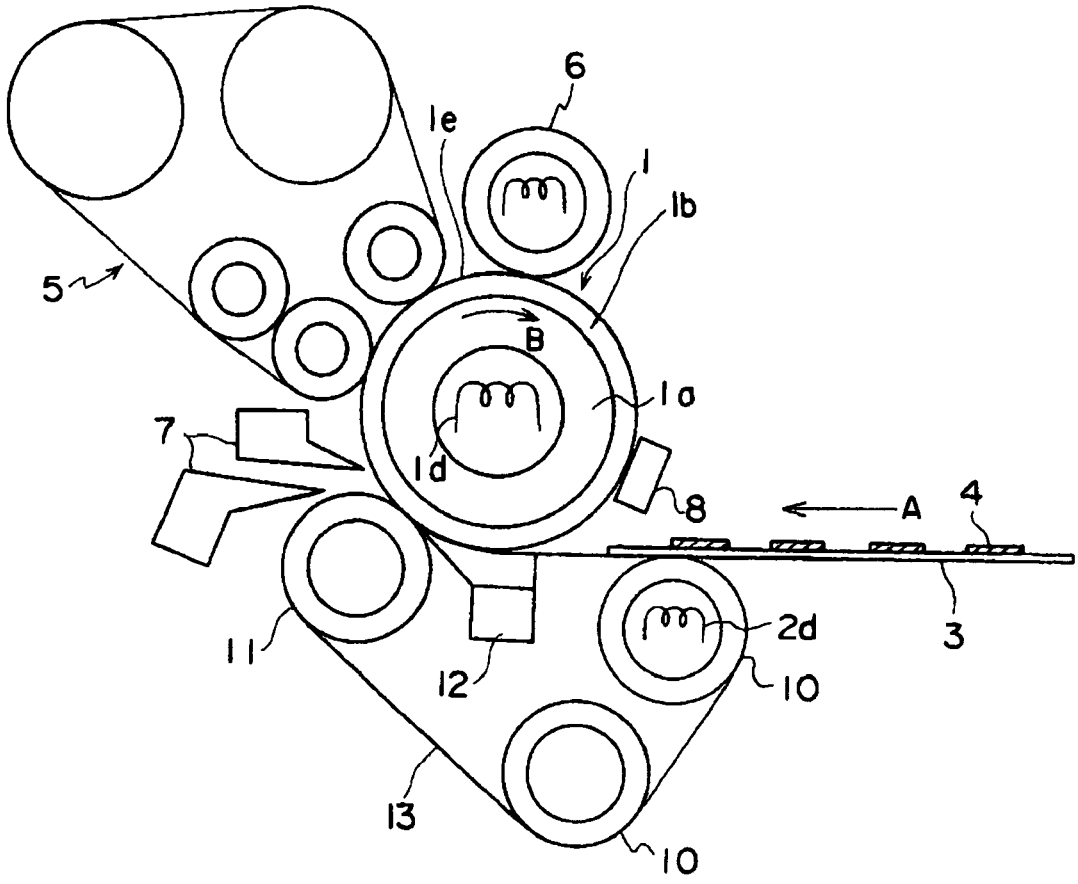
FIG. 15 is a schematic view of a heat roll/belt-type fixing apparatus according to a second exemplary embodiment of the fixing apparatus of the invention.

FIG. 15 is a schematic view of the fixing apparatus according to a second exemplary embodiment of the fixing apparatus of the invention, i.e., a heat roll/belt-type fixing apparatus. The heat roll/belt-type fixing apparatus according to the second exemplary embodiment of the invention has a pair of fixing units including a heat roll and a pressing belt that comes in contact with the heat belt, in which a recording medium having a non-fixed toner image thereon is passed through the contact portion formed by the heat roll and pressing belt, thereby fixing the image by heat and pressure.

In the heat roll/belt-type fixing apparatus shown in FIG. 15, a heat roll 1 and pressing belt 13, a pair of fixing devices constituting the main part of the fixing apparatus, are arranged so as to face each other and contact with each other to form a contact portion.

The pressing belt 13 is pressed against and brought in contact with the heat roll 1 by a pressing pad 12 (pressing member) and pressing roll 11 (pressing member) arranged inside the loop of the pressing belt 13, thereby forming a contact portion. The pressing pad 12 (pressing member) has a contact portion (pressing portion) which contacts with the pressing belt 13 and is in the form of a pad. The contact portion or the vicinity thereof may include a rubber-like elastic part.

In the fixing apparatus according to the exemplary embodiment, the expression "a contact portion is in the form of a pad" means that the portion of the pressing pad 12 which contacts with the pressing belt 13 is shaped so that the surface of the heat roll 1 and the inner periphery of the pressing belt 13 trained onto the pressing roll 11 and two support rolls 10 to closely contact with each other. In the phrase "the contact portion or the vicinity thereof", the term "vicinity" means a portion in the vicinity of the contact portion of the pressing pad 12 from which elasticity can be endowed to the contact portion by an elastic portion, and generally corresponds to the contact portion and a portion in the range of up to about 10 mm in the vertical direction from the contact portion, in the pressing pad 12. The phrase "the contact portion or the vicinity thereof contains a rubber-like elastic part" means that at least a part of the contact portion or the portion in the vicinity thereof is composed of an elastic material. The rubber-like elastic part refers to heat resistant rubber represented by silicone rubber, fluorine rubber or the like.

The pressing pad 12 may have plural pressing portions having different hardness along the direction in which the recording medium travels. In this case, it is preferable that one pressing portion is composed of a rubber-like elastic member and the other pressing portion is composed of a rigid pressing member of a metal and the like. When the pressing pad 12 includes plural pressing portions having different hardness, the pressure in the contact region at the side from which a recording medium ejected is preferably higher than that at the side from which the recording medium enters, from the viewpoint of improving releasability of the recording medium (this effect can be particularly remarkable in a case where a thin recording medium is used). For example, by constituting the pressing portion at the side from which the recording medium enters in the pressing pad 12 by a rubber-like elastic member, and the pressing portion at the side from which a recording medium ejected by a rigid pressing member of a metal and the like, whereby the pressure in the contact region in the recording medium entering side can be preferably made higher than the pressure in the contact region in the recording medium ejecting side.

For improving sliding properties between the pressing pad 12 and the inner surface of the pressing belt 13, the pressing pad 12 may be arranged via a slide sheet composed of heat-resistant resin or fluororesin interposed therebetween.

The heat roll 1 is composed by forming an elastic layer 1*b* and releasing layer 1*c* in this order on a cylindrical core 1*a* having a heat source 1*d* therein.

The pressing belt 13 is stretched and trained onto two support rolls 10 and one pressing roll 11, and one of the support rolls 10 has a heat source 2*d* therein. A toner image 4 is formed on a recording medium 3 such as a plain paper sheet.

On the outer periphery of the heat roll 1 there are provided a cleaning unit 5 for cleaning the surface of the roll, an external heating device 6 for heating the heat roll 1 from the surface thereof, a release nail 7 for releasing a paper sheet after fixation, and a temperature sensor 8 for controlling the surface temperature of the heat roll 1.

In the fixing apparatus shown in FIG. 15, fixation treatment is carried out according to the following processes. The recording medium 3 having a non-fixed toner image 4 thereon is delivered in the direction indicated by arrow A, by a delivery device (not shown) and a pressing belt 13, then inserted through a contact region formed by the pressing belt 13 and heat roll 1 rotated in the direction of arrow B contacting with each other. In this step, the recording medium 3 passes through the contact region such that the side of the recording medium 3 with the non-fixed toner image 4 and the surface of the heat roll 1 face each other. When the recording medium 3 passes through this contact region, heat and pressure are applied to the recording medium 3, whereby the non-fixed toner image 4 is fixed onto the recording medium 3. The recording medium after fixation is then released from the heat roll 1 by a release nail 7 and ejected from the heat roll/belt-type fixing apparatus.

Figure 16:
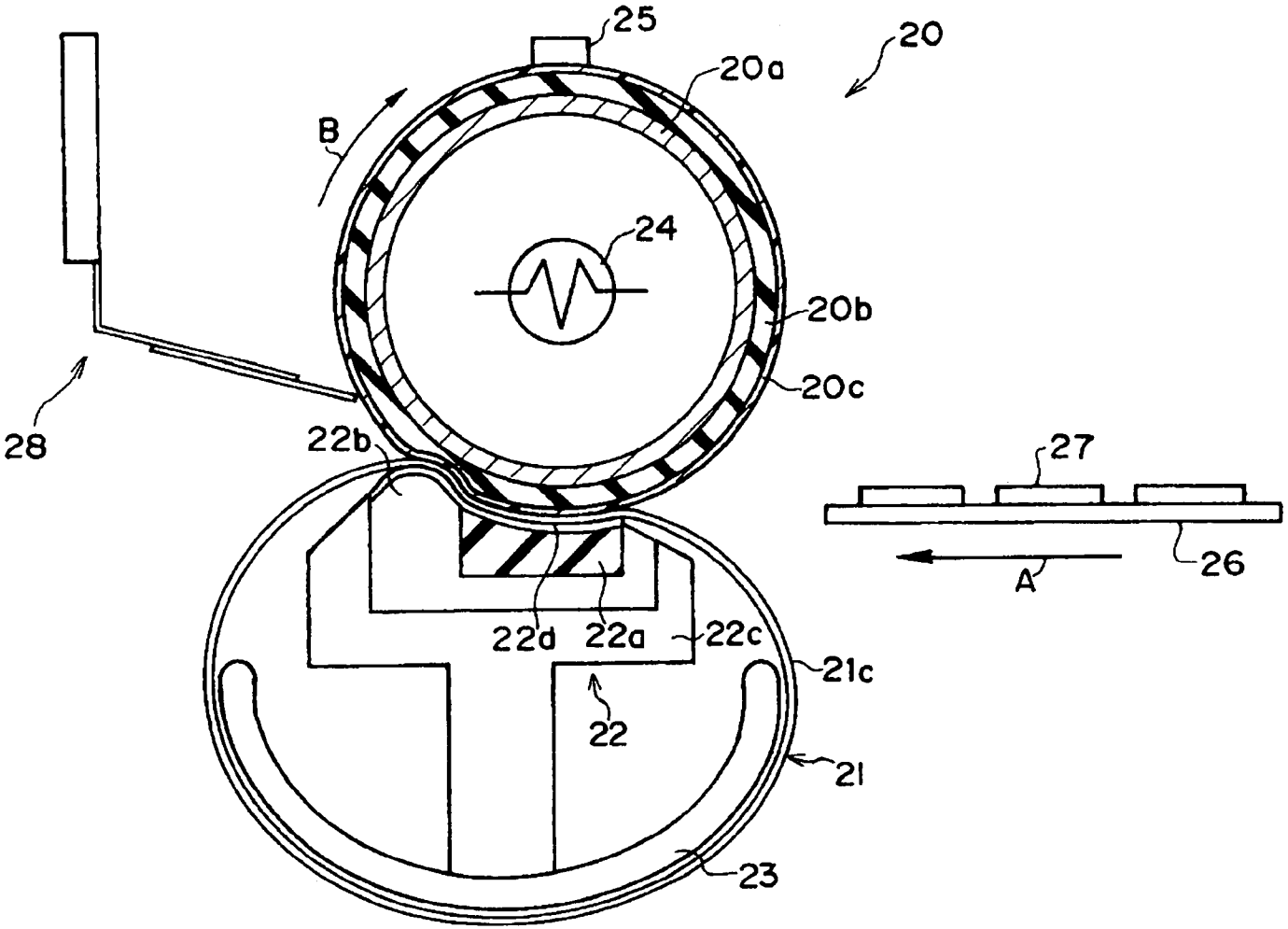
FIG. 16 is a schematic view of a free belt-type fixing apparatus which accords to a modified version of the second exemplary embodiment of the fixing apparatus of the invention.

FIG. 16 is a schematic view of a free belt-type fixing apparatus which accords to a modified version of the second exemplary embodiment of the fixing apparatus of the invention. The free belt-type fixing apparatus shown in FIG. 16, which is a variation of the heat roll/belt-type fixing apparatus designed with the aims of further downsizing, energy saving and speeding, does not have a support roll or pressing roll for stretching and training of the belt. A pressing belt 21 is guided along a belt running guide 23, and is driven by the driving force imparted by a heat roll 20. The fixing apparatus having such a structure is called a free belt-shaped fixing apparatus, in distinction from an apparatus having a support roll and/or a pressing roll (fixing apparatus shown in FIG. 15).

In the free belt-type fixing apparatus shown in FIG. 16, the heat roll 20 and pressing belt 21, a pair of fixing devices constituting the main part of the device, are arranged so as to face each other and contact with each other to form a contact portion.

The pressing belt 21 is pressed against and brought into contact with the heat roll 20 by the pressing pad 22 (pressing device) arranged inside the loop of the belt, thereby forming a contact portion and being driven by the driving force from the heat roll 20 along the belt running guide 23 as described above.

The pressing pad 22 (pressing device) has two pressing portions 22*a* and 22*b*, one of which has a hardness different from that of the other, along the direction in which a recording medium travels. The pressing portion 22*a* placed on the entry side of the recording medium on the pressing pad 22 is composed of a rubber-like elastic member, and the pressing portion 22*b* on the exit side of the recording medium is composed of a rigid pressing member such as metal, whereby the pressure in the contact region on the exit side of the recording medium is made higher than the pressure on the entry side of the recording medium. In such a constitution, releasability of a recording medium is improved. This effect can be particularly remarkable in a case where a thin recording medium is used. The pressing portions 22*a* and 22*b* are supported by a holder 22*c*, and the inner periphery of the pressing belt 21 is pressed against a heat roll 20 via a low-friction layer 22*d* made of a glass fiber sheet containing TEFLON® (manufactured by DuPont), a fluororesin sheet or the like.

The heat roll 20 is formed by providing an elastic layer 20*b* and a releasing layer 20*c* on a cylindrical core 20*a* having a heat source 24 therein.

The heat roll 20 is provided therearound with a release blade 28 for releasing a paper sheet after fixation and a temperature sensor 25 for regulating the surface temperature of the roll.

In the fixing apparatus shown in FIG. 16, as is the case with the fixing apparatus in FIG. 15, the recording medium 26 having a non-fixed toner image 27 thereon is delivered in the direction of an arrow A by a delivery device (not shown), and passes through a contact region formed by contact of a pressing belt 21 and a heat roll 20 driven to rotate in the direction of an arrow B. At this time, the recording medium 26 passes through the contact region such that the surface of the recording medium 26 having the non-fixed toner image 27 thereon and the surface of the heat roll 20 face each other. When the recording medium 26 passes through this contact region, the non-fixed toner image 27 is fixed onto the recording medium 26 by heat and pressure applied to the recording medium 26. After passing through the contact region, the recording medium 26 after being subjected to fixation is released from the heat roll 20 by the release blade 28 and ejected from the free belt-type fixing apparatus. In this manner, the fixation treatment is carried out.

In a heat roll/belt-type fixing apparatus, the time length for a recording member having a non-fixed toner image thereon to pass through a contact portion formed by a heat roll and pressing belt (time for passing through the contact portion) is desirably about 0.030 second or more. When this time for passing through the contact portion is shorter than about 0.030 second, favorable fixing properties and prevention of wrinkling of paper sheets or curling are hardly satisfied at the same time, and in consequence, the fixing temperature may be required to be raised, resulting in loss of energy, lowering of durability of the members, or temperature increase in the device. While the upper limit of the time for the recording medium to pass through the contact portion is not particularly limited, it is preferably about 0.5 second or less from the viewpoint of balance between the processing ability for fixation treatment and the size of the apparatuses and devices.

Figure 17:
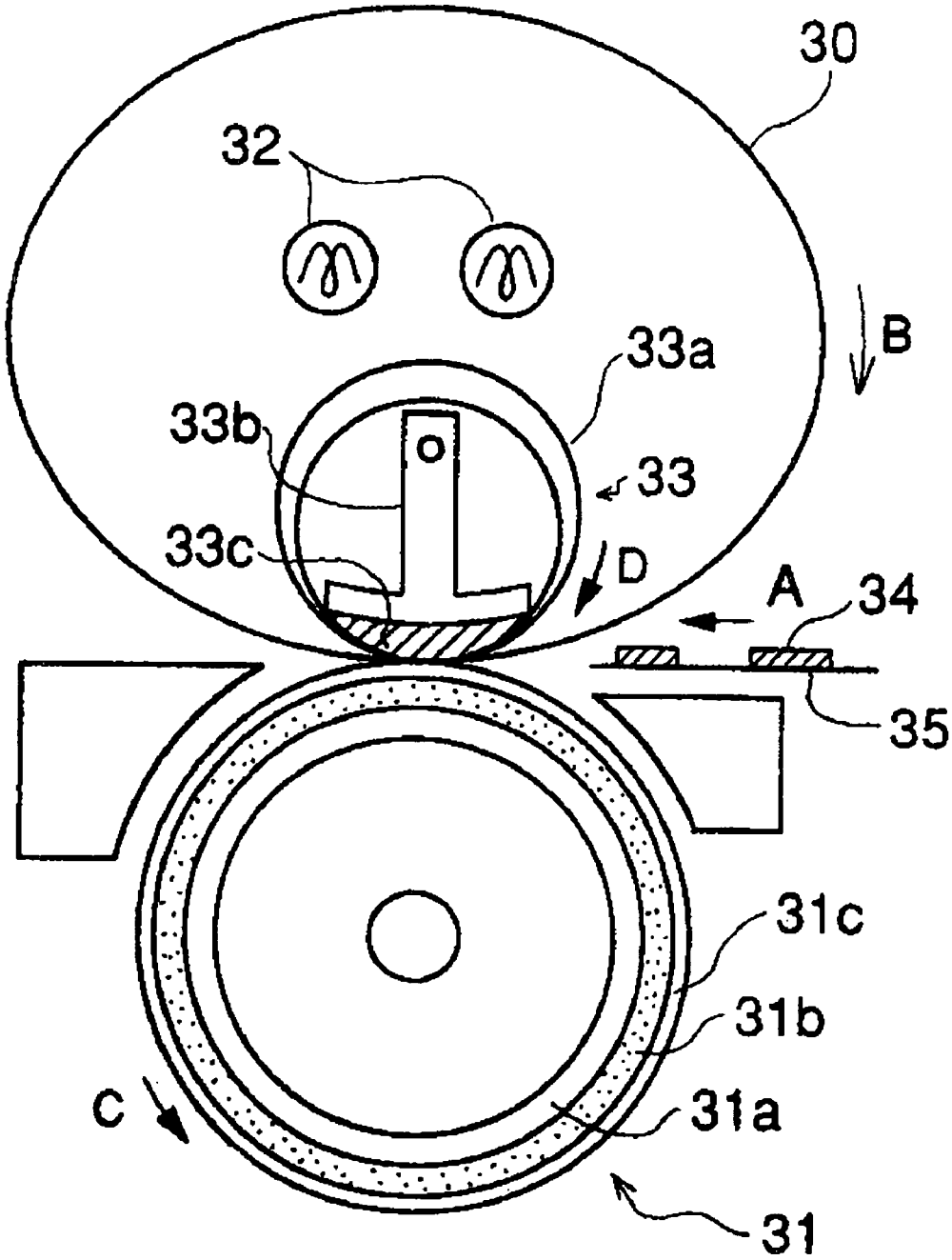
FIG. 17 is a schematic view of a heat belt/roll-type fixing apparatus according to a third exemplary embodiment of the fixing apparatus of the invention.

FIG. 17 is a schematic view of the fixing apparatus according to a third exemplary embodiment of the fixing apparatus of the invention, i.e., a heat belt/roll-type fixing apparatus. In the heat belt/roll-type fixing apparatus according to the third exemplary embodiment, a recording medium having a non-fixed toner image thereon passes through a contact portion formed by a heat belt and a pressing roll, and the image is fixed by heat and pressure.

In the heat belt/roll-type fixing apparatus shown in FIG. 17, the member indicated by number 30 is a heat belt composed of a releasing layer formed on a support made of a heat-resistant base film (such as a polyimide film or the like). A pressing roll 31 is arranged so as to be in contact with the heat belt 30, thereby forming a contact portion. The pressing roll 31 is constituted by forming an elastic layer 31*b* made of silicone rubber or the like on a support 31*a*, and further forming a releasing layer 31*c* thereon.

Inside of the heat belt 30, a pressing device 33 having a pressing roll 33*a* made of iron or the like, an inverted T-shaped pressing device 33*b*, and a metal pad 33*c* impregnated with a lubricant are arranged in a position opposite the pressing roll 31, and the pressing device 33*b* presses the heat belt 30 via the pressing roll 33*a* against the pressing roll 31, thereby applying suppress strength to the contact portion. At this time, the pressing device 33*b* applies suppress strength while the metal pad 33*c* slides along the inner surface of the pressing roll 33*a*. The inner surface of the pressing roll 33*a* is preferably coated with heat-resistant oil having lubricity.

A heat source 32 such as a heater lamp for heating the contact portion of the heat belt 30 is arranged inside of the heat belt 30.

The heat belt 30 is rotated in the direction of arrow B in accordance with the rotation of the pressing roll 33*a* in the direction of arrow D, and accordingly, the pressing roll 31 is also driven to rotate in the direction of arrow C. A recording medium 35 having a non-fixed toner image 34 formed thereon passes through the contact portion of the fixing apparatus in the direction of arrow A, then heat-melted and pressurized to fix the toner image.

Figure 18:
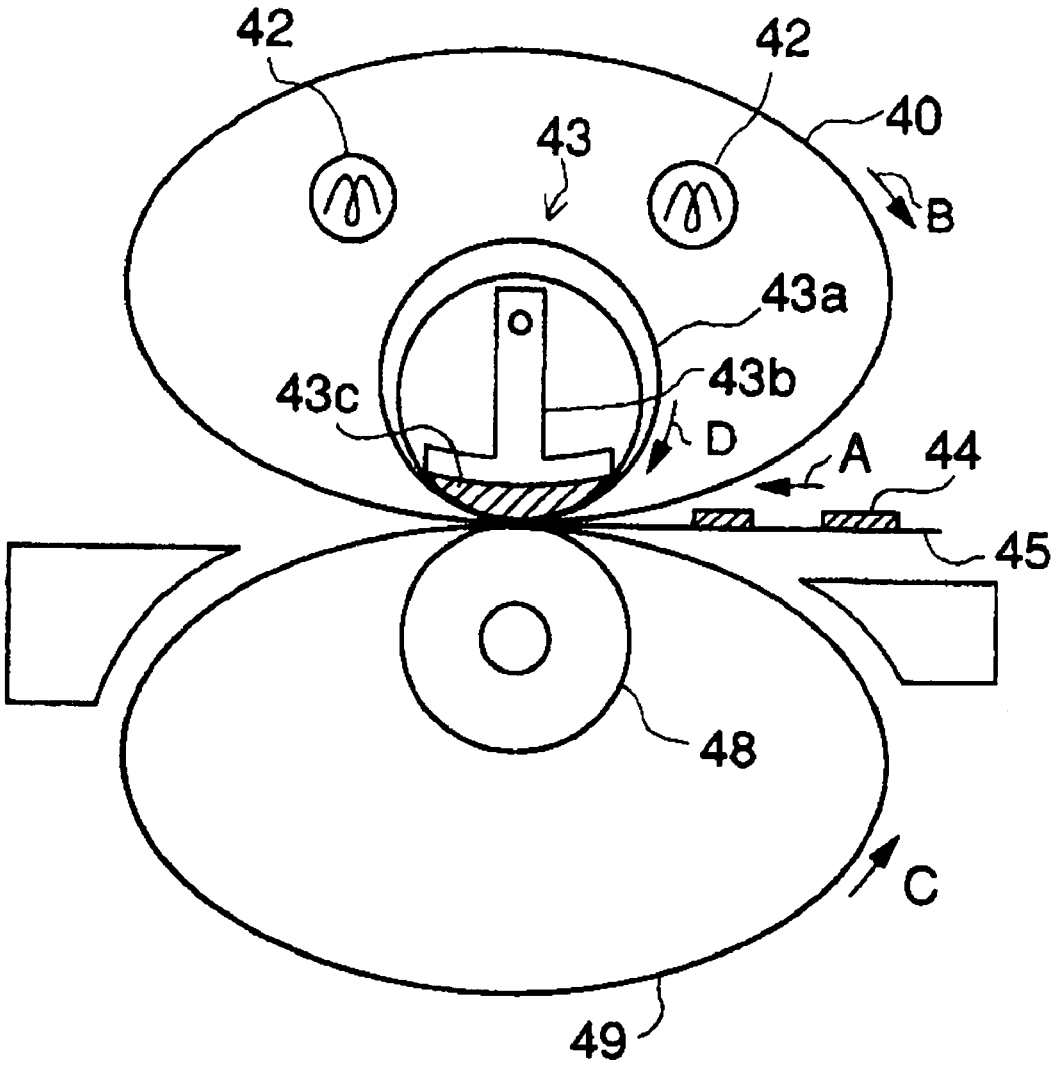
FIG. 18 is a schematic view of a heat belt-type fixing apparatus in accordance with a fourth exemplary embodiment of the fixing apparatus of the invention.

FIG. 18 is a schematic view of the fixing apparatus in accordance with a fourth exemplary embodiment of the fixing apparatus of the invention, i.e., a heat belt-type fixing apparatus. In the heat belt-type fixing apparatus according to the fourth exemplary embodiment, a recording medium having a non-fixed toner image thereon passes through a contact portion formed by a heat belt and a pressing belt, and the image is fixed by heat and pressure.

In the heat belt-shaped fixing apparatus shown in FIG. 18, the constitution of a heat belt 40, heat source 42 such as a heater lamp, and a pressing device 43 (a pressing roll 43*a*, pressing device 43*b* and a metal pad 43*c*) is the same as that of the fixing apparatus shown in FIG. 17, i.e., a heat belt 30, heat source 32 such as a heater lamp and the pressing device 33 (a pressing roll 33*a*, pressing device 33*b* and a metal pad 33*c*).

A pressing roll 49 is arranged so as to form a contact area with the heat belt 40, and a contact portion is formed by the heat belt 40 and pressing belt 49. The pressing belt 49 has the same constitution as that of the heat belt 40. Inside of the pressing belt 49 is arranged a pressing roll 48 made of silicone rubber or the like in a position opposite the pressing device 43, thereby applying suppress strength to the contact portion.

The heat belt 40 is rotated in the direction of arrow B in accordance with the rotation of the pressing roll 43*a* in the direction of arrow D, and accordingly the pressing belt 49 is also driven to rotate in the direction of arrow C. A recording medium 45 having a non-fixed toner image 44 formed thereon passes through the contact portion of the fixing apparatus, in the direction of arrow A, and heat-melted and pressurized to fix the toner image.

Image Forming Apparatus

Details of the image forming apparatus of an exemplary embodiment of the invention will be hereinafter described. The image forming apparatus of the exemplary embodiment of the invention is not particularly limited insofar as the apparatus is provided with the fixing apparatus of the invention as a fixing means. Specifically, the image forming apparatus preferably has at least a latent image holding member, a charging unit for charging the surface of the latent image holding member, a latent image formation unit for forming a latent image on the surface of the charged latent image holding member, a toner image formation unit for developing the latent image with a developer to form a toner image, a transfer unit for transferring the toner image from the surface of the latent image holding member onto a surface of a recording medium, and a fixing unit for fixing the toner image transferred onto the surface of the recording medium (i.e., the fixing apparatus of an exemplary embodiment of the invention).

Hereinafter, the image forming apparatus provided with the fixing apparatus of the invention (i.e., the image forming apparatus of an exemplary embodiment of the invention) is described by referring to the drawings.

First Exemplary Embodiment

Figure 19:
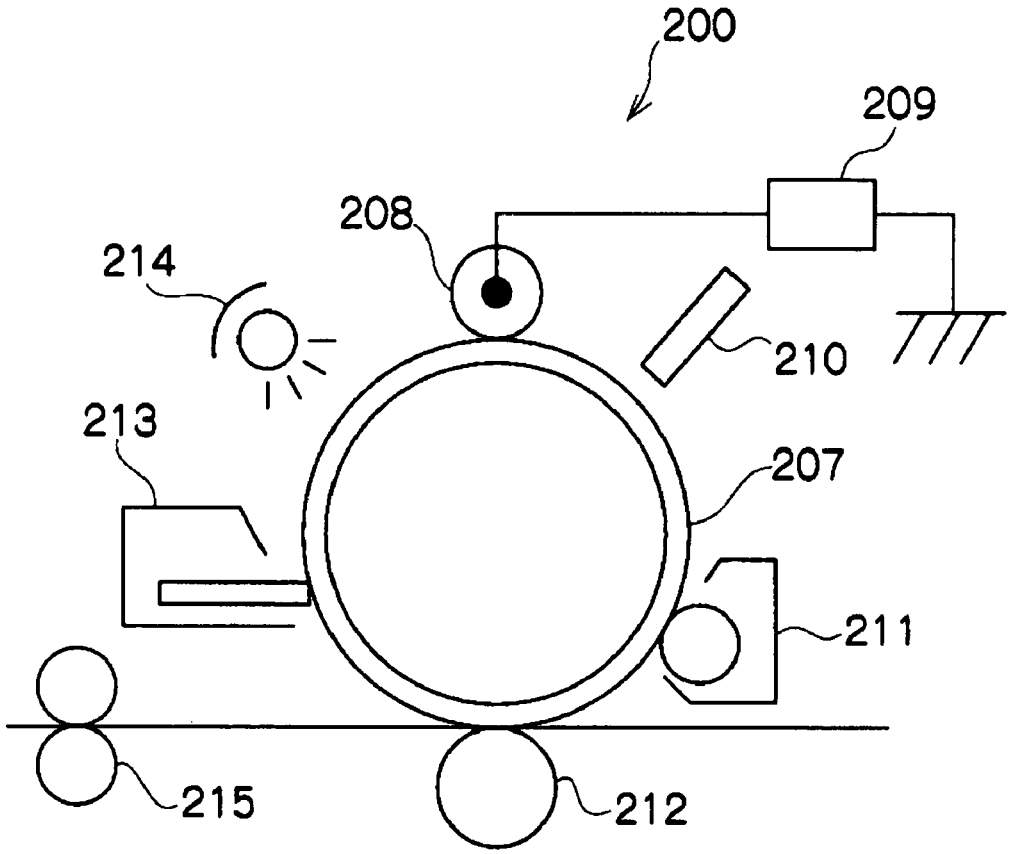
FIG. 19 is a schematic view of an image forming apparatus according to a first exemplary embodiment of the image forming apparatus of the invention.

FIG. 19 is a schematic view of the image forming apparatus according to the first exemplary embodiment of the image forming apparatus of the invention. The image forming apparatus 200 shown in FIG. 19 includes a latent image holding member 207, a charging device 208 for charging the latent image holding member 207 by a contact charging system, a power supply 209 connected to the charging device 208, an exposure device 210 for exposing the latent image holding member 207 charged with the charging device 208 to light to form an electrostatic latent image, a developing device 211 for developing the electrostatic latent image formed by the exposure device 210 with a toner to form a toner image, a transfer device 212 for transferring the toner image formed by the developing device 211 onto an image-receiving medium, a cleaning device 213, an erasing device 214, and a fixing apparatus of the invention 215. Although not shown in FIG. 19, the image forming apparatus is also provided with a toner feeding device for feeding a toner to the developing device 211. In an exemplary embodiment which is other than this exemplary embodiment, the erasing device 214 may not be provided.

A toner image forming unit is configurated by the latent image holding member 207, the charging device 208, the power supply 209, the exposure device 210, the developing device 211, the transfer device 212, the cleaning device 213 and the erasing device 214.

The charging device 208 is a device for charging the surface of the latent image holding member at a predetermined potential by contacting an electroconductive device (charging roll) with the surface of the latent image holding member 207 and uniformly applying voltage to the latent image holding member. The charging device disposed in the image forming apparatus of the invention may be a charging device of non-contact charging type such as a corotron or scorotron.

When the electroconductive device is used to charge the latent image holding member 207, voltage is applied to the electroconductive device. The voltage to be applied may be either direct-current voltage or direct-current voltage superimposed with alternating-current voltage. In addition to the charging roll shown in this embodiment, charging may also be conducted using a contact charging-type charging device such as a charging brush, charging film or a charging tube. Further, charging may also be conducted using a non-contact charging-type charging device such as a corotron or scorotron.

As the exposure device 210, an optical device capable of performing desired imagewise exposure to the surface of the latent image holding member 207 with a light source such as semiconductor laser, LED (light emitting diode), liquid crystal shutter or the like can be used. Among these, when an exposure device capable of exposing with incoherent light is used, generation of interference pattern between an electroconductive support and a photosensitive layer which constitute the latent image holding member 207.

The developing unit 211 may be, for example, a generally-used developing device capable of developing an electrostatic latent image by allowing the device to be in contact, or in non-contact, with a magnetic or non-magnetic, one-component or two-component developer. The developing device is not particularly limited as far as it has the function, and can be appropriately selected depending on purposes.

Examples of the transfer devices for the transfer device 212 include a roller-shaped contact charging member as well as a contact-type transfer charging device using a belt, a film, a rubber blade or the like, and devices utilizing corona discharge such as a scorotron transfer charging device or a corotron transfer charging device.

The cleaning device 213 is provided for removing residual toner adhering to the surface of the latent image holding member after a toner image has been transferred. The latent image holding member having a surface cleaned with the cleaning device is used repeatedly in the image forming process. Examples of the cleaning device include the one using a cleaning blade shown in the figure as well as other devices using methods such as brush cleaning, roll cleaning or the like. Among these, the cleaning blade is preferably used. Examples of the material of the cleaning blade include urethane rubber, neoprene rubber, silicone rubber and the like.

The image-forming apparatus in the exemplary embodiment is provided with an erasing device (an erase light-irradiating device) 214, as shown in FIG. 19. The phenomenon of bringing residual potential of the latent image holding member into a next image forming cycle, which could occur when the erasing device is repeatedly used, can be prevented by the erasing device. Accordingly, image qualities can be further improved thereby.

Second Exemplary Embodiment

Figure 20:
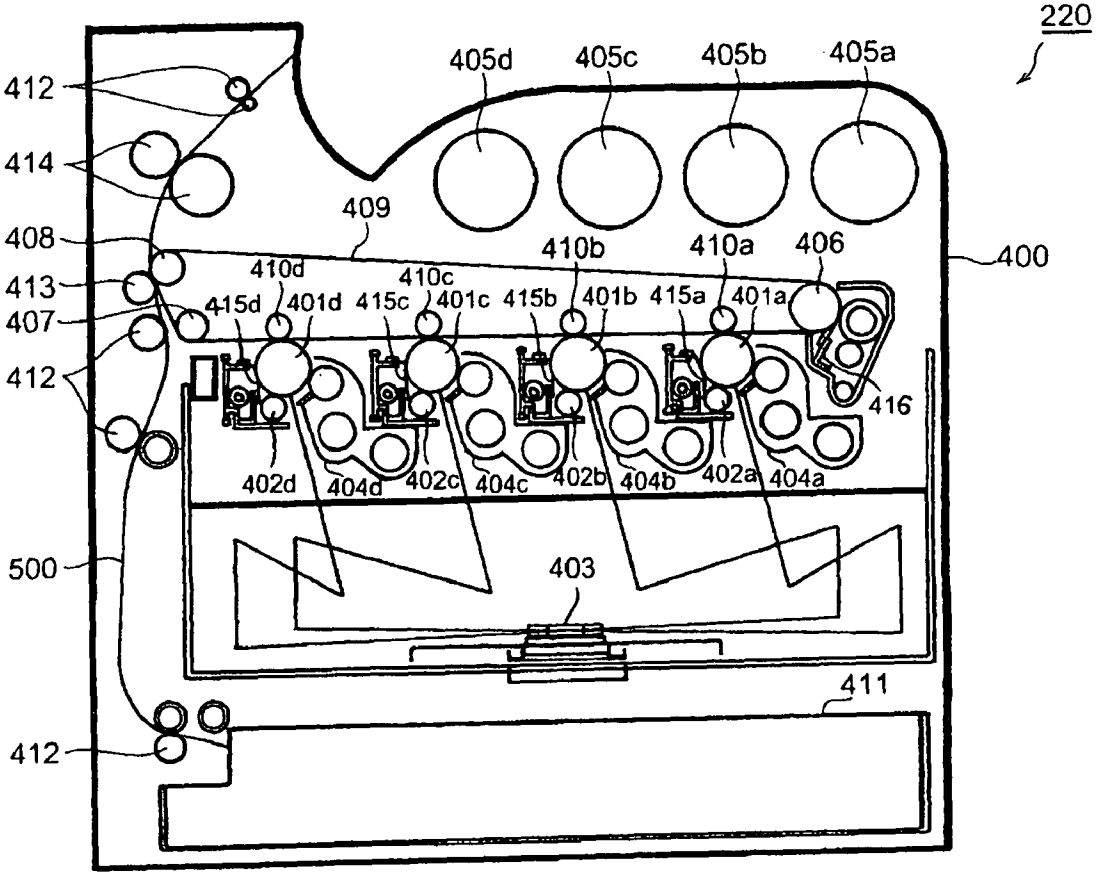
FIG. 20 is a schematic view of an image forming apparatus according to a second exemplary embodiment of the image forming apparatus of the invention.

FIG. 20 is a schematic view of the image forming apparatus according to the second exemplary embodiment of the image forming apparatus of the invention. The image forming apparatus 220 shown in FIG. 20 is an intermediate transferring-type electrophotographic apparatus, and in a housing 400, four latent image holding members 401*a* to 401*d* (for example, images of yellow, magenta, cyan and black can be respectively formed by each of the latent image holding members 401*a*, 401*b*, 401*c* and 401*d*) are arranged in parallel with one another along the intermediate transfer belt 409.

In the image forming apparatus, four toner image-forming units respectively corresponding to the four colors are provided, and a toner image-forming unit for yellow, for example, is composed of a latent image holding member 401*a*, a charging roll 402*a*, a developing device 404*a*, a primary transfer roll 410*a*, and a cleaning blade 415*a*.

The latent image holding member 401*a* can be rotated in a predetermined direction (anticlockwise direction in the figure), and the charging roll 402*a*, the developing device 404*a*, the primary transfer roll 410*a*, and the cleaning blade 415*a* are arranged along this rotation direction. The developing device 404*a* can be supplied with a yellow toner contained in a toner cartridge 405*a*, and the primary transfer roll 410*a* contacts the latent image holding member 401*a* via the intermediate transfer belt 409.

This configuration is also applied to the cases of the toner image forming units for each of cyan, magenta and black.

In the housing 400, a laser light source (exposure device) 403 is further provided at the predetermined position, and from which laser light can be emitted and applied to the surfaces of the latent image holding members 401*a* to 401*d* after charging.

By providing the configuration, charging, exposure, development, primary transferring and cleaning are carried out in this order when the latent image holding members 401*a* to 401*d* are rotated at the time of image formation, and toner images of respective colors are transferred onto the intermediate transfer belt 409 in an overlapping manner.

The intermediate belt 409 is supported by a driving roll 406, facing roll 408 and a tension roll 407 with a predetermined degree of tension, and is capable of rotating without sagging by the rotation of these rolls. A secondary transfer roll 413 is arranged so as to be in contact with the facing roll 408 via the intermediate transfer belt 409. The intermediate transfer belt 409, arranged so as to be sandwiched between the facing roll 408 and the secondary transfer roll 413, is cleaned with, for example, a cleaning blade 416 disposed on the position opposite the outer periphery of the driving roll 406, and then repeatedly used in a subsequent image forming processes.

A recording medium holder 411 is arranged at a predetermined position in the housing 400, and a recording medium 500 such as a paper sheet placed in the recording medium holder 411 is transferred via a transfer roll 412 to a contact portion between the intermediate transfer belt 409 and the secondary transfer roll 413, then to the fixing apparatus 414, and ejected out of the housing 400.

While the explanation of the exemplary embodiments, the intermediate transfer belt 409 is used as an intermediate transfer body, the intermediate transfer body may be in a form of a belt similarly to the intermediate transfer belt 409, or may be in a form of a drum.

The recording medium is not particularly limited insofar as a toner image formed on the latent image holding member can be fixed onto the surface thereof, and may be made of paper, resin film or the like.

EXAMPLES

Hereinafter, the invention is described in more detail by referring to the following Examples, while the invention is not limited thereto.

Example 1

Preparation of Base-roll

The outer periphery of a cylindrical core which is made of aluminum (trade name: CM-10, manufactured by Sumitomo Light Metal Industries Ltd.) and has an outer diameter of 24.8 mm, a wall thickness of 0.5 mm and a length of 400 mm is subjected to a pretreatment by degreasing with toluene and spraying a primer (trade name: DY35-051 A/B, manufactured by Dow Corning Toray Silicon, Co., Ltd.) onto the region to be coated with an elastic layer (the region of 340 mm in length, i.e., excluding the regions at the both ends of 30 mm, respectively, from the total length of 400 mm) using a brush. Then, this cylindrical core is air-dried for 30 minutes and baked for 30 minutes in an oven at 150° C.

The difference between of the maximum value of the outer diameter of the aluminum cylindrical core (base material) and the minimum value thereof is 0.010 mm. With regard to variations of the outer diameter of the aluminum cylindrical core, the positive variation of the outer diameter in comparison with the average outer diameter is 0.023%, and the negative variation of the outer diameter in comparison with the average outer diameter is −0.017%. Accordingly, the outer diameter of the aluminum cylindrical core is recognized as being constant.

Subsequently, the pretreated cylindrical core is set in a cylindrical metallic sleeve frame having an inner diameter of 26.0 mm and fixed at the center of the sleeve frame with upper and lower cap flames. In this state, liquid silicone rubber (trade name: DX35-2120A/B, manufactured by Dow Corning Toray Silicon, Co., Ltd.) is cast from a die gate into a difference between the outer periphery of the cylindrical core and the inner periphery of the sleeve frame and baked in an oven at 150° C. for 1 hour to obtain a base-roll having an elastic layer which has a thickness of 0.6 mm and is formed on the outer periphery of the cylindrical core.

Subsequently, a primer for silicone rubber (trade name: PR-990CL, manufactured by Mitsui Dupont Fluorochemicals Company, Ltd.) is applied onto a surface of the base-roll so as to form a film having a thickness of 0.5 μm, and a thermal treatment is performed in a circulating type oven at 100° C. for 30 minutes so as to form an elastic layer.

The difference between of the maximum value of the thickness of the elastic layer thus formed and the minimum value thereof is 0.015 mm. With regard to variations of the outer diameter, the positive variation of the thickness in comparison with the average thickness is 0.985%, and the negative variation of the thickness in comparison with the average thickness is −1.498%. Accordingly, the thickness of the elastic layer is recognized as being constant.

Surface Layer Formation

PFA Dispersion Liquid

As a PFA dispersion liquid that is used to form the surface layer, one that includes a first PFA resin particle having an average particle diameter of 0.5 μm (trade name: 350HP-J, manufactured by Mitsui Dupont Fluorochemicals Company, Limited) and a second PFA resin particle having an average particle diameter of 5 μm (trade name: 340HP-J, manufactured by Mitsui Dupont Fluorochemicals Company, Limited) is prepared as its PFA resin components. A fraction ratio by weight of the first PFA resin particle/the second PFA resin particle is 75/25. The dispersion liquid has a solid concentration of 20 weight % and is an aqueous dispersion liquid including water as a solvent.

Coating Apparatus (Inkjet Apparatus)

A piezo-type inkjet head for an inkjet recording apparatus (trade name: PIXELJET 64, manufactured by Trident Co., Ltd.) is used as a liquid droplet discharge head. As shown in FIG. 6, the inkjet head is an integrated type head in which plural liquid droplet discharge heads are integrated. When formation of a surface layer is performed, the PFA dispersion liquid is discharged from only one of the plural liquid droplet discharge heads. The liquid droplet discharge head is provided with 2 rows, each of which has 32 nozzles.

Furthermore, as shown in FIG. 6, a base-roll (cylindrical support) is disposed so that its axial direction is in a horizontal direction and set so as to be rotated at a predetermined speed when liquid droplets are ejected from the liquid droplet discharge head onto the base-roll.

The integrated head is disposed immediately above the base-roll in an axial direction so as to be able to scan in an axial direction of the base-roll with the shortest distance between an apex portion of the base-roll and nozzle mouths of the liquid droplet discharge head maintained at a distance of 10 mm. Furthermore, the integrated head is disposed so that the nozzle rows of the respective liquid droplet discharge heads and the axial direction of the base-roll are perpendicular to each other.

The liquid droplet eject amount per unit time period from the liquid droplet discharge head is controlled in such a manner as shown below. That is, the number of liquid droplets ejected from the liquid droplet discharge head per unit time period is fixed at a constant value by fixing a frequency at a constant value of 10000 Hz and a pulse intensity is controlled with respect to an axial direction of the base-roll to control the diameter of the liquid droplets ejected from the liquid droplet discharge head.

The average diameter of liquid droplets ejected from the liquid droplet discharge head is obtained from diameters of liquid drops, which are measured by turning on an LED toward a liquid droplet simultaneously with an ejection timing and by visually observing an image with a CCD camera.

Surface Layer Formation (Formation of Coated Film)

Next, by use of the foregoing coating apparatus, with the base-roll rotating at 200 rpm, while the scanning speed of the integrated head is controlled over the range where the elastic layer is formed from one end portion to the other end portion, the PFA dispersion liquid is ejected onto the surface of the base-roll.

A liquid droplet diameter at that time is set at 15 pl (maximum liquid droplet diameter) at a center portion (a position distanced by 170 mm from any one end in the axial direction of the elastic layer) and at 6 pl (minimum liquid droplet diameter) in the vicinity of both end portions (a region of 0 to 20 mm and a region of 320 to 340 mm in the axial direction of the elastic layer).

Furthermore, the scanning speed is set at 17.63 mm/min (maximum scanning speed) at a center portion (a position distanced by 170 mm from any one of ends in an axial direction of an elastic layer) and at 14.72 mm/min (minimum scanning speed) in the vicinity of both end portions (a region of 0 to 20 mm and a region of 320 to 340 mm in an axial direction of an elastic layer).

When the integrated head is moved from one end portion toward the center portion, except for the vicinity of the end portion, an eject amount from the liquid droplet discharge head is controlled so that a variation amount of a liquid droplet diameter to a unit scanning distance may be linearly increased, and when the integrated head is moved from the center portion toward the other end portion, except for the vicinity of the end portion, an eject amount from the liquid droplet discharge head is controlled so that a variation amount of a liquid droplet diameter to a unit scanning distance may be linearly decreased.

Furthermore, when the integrated head is moved from one end portion toward a center portion, except for the vicinity of the end portion, an eject amount from the liquid droplet discharge head is controlled so that a variation amount of a scanning speed to a unit scanning distance may be linearly decreased, and when the integrated head is moved from the center portion toward the other end portion, except for the vicinity of the end portion, an eject amount from the liquid droplet discharge head is controlled so that a variation amount of the scanning speed to a unit scanning distance may be linearly increased.

Figure 21:
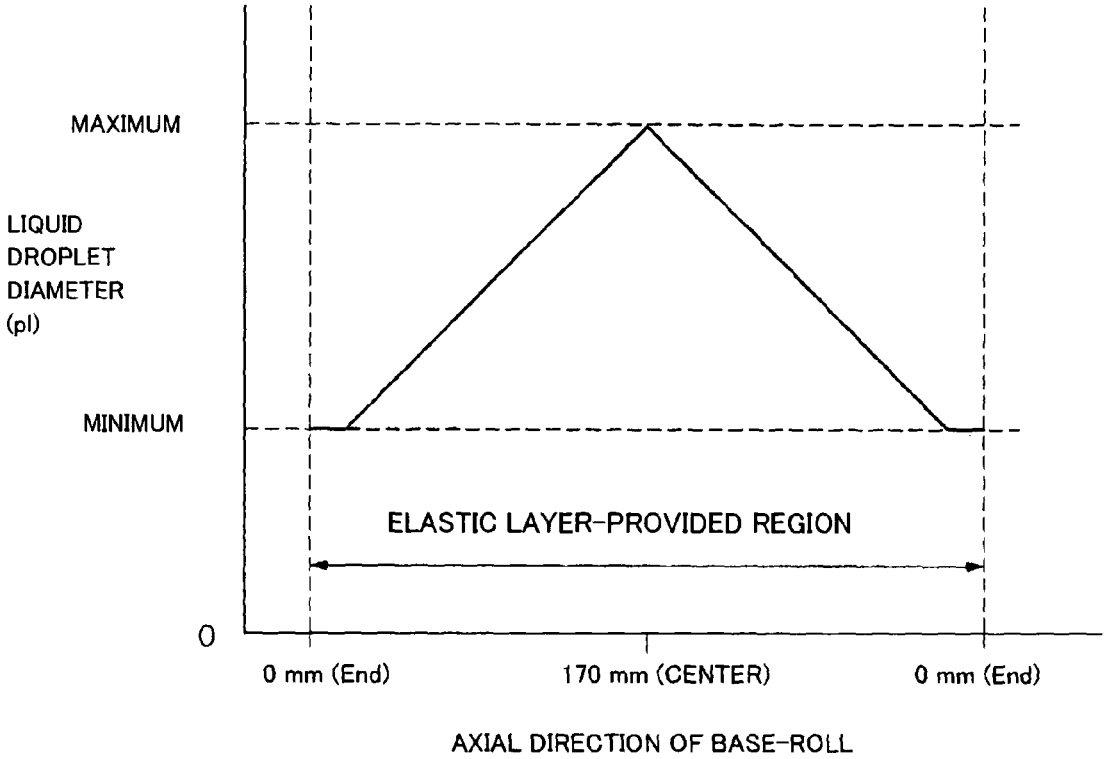
FIG. 21 is a graph showing a variation of a diameter of a liquid droplet ejected form a liquid droplet discharge head to an axial direction of a base-roll used in Example 1.
Figure 22:
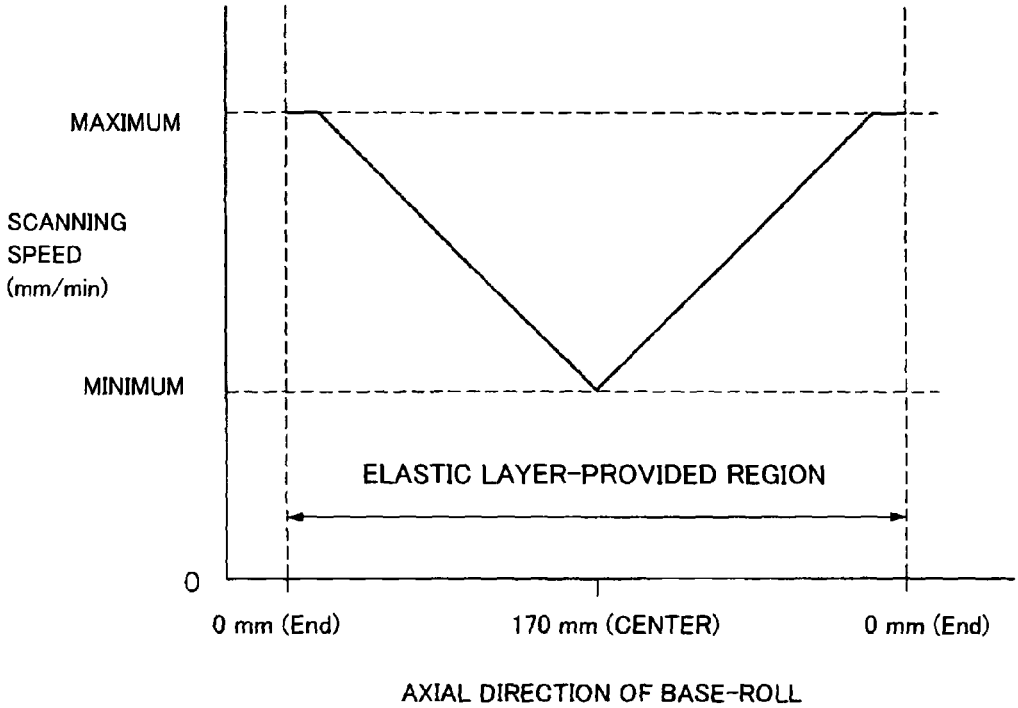
FIG. 22 is a graph showing a variation of a variation of a scanning speed of the liquid droplet discharge head to an axial direction of a base-roll used in Example 1.

For the purpose of reference, a variation of a diameter of a liquid droplet ejected form a liquid droplet discharge head to an axial direction of the base-roll at this time is shown in FIG. 21 and a variation of a scanning speed of the liquid droplet discharge head is shown in FIG. 22.

Surface Layer Formation (Drying, Calcining)

In the next place, the roll having the coated film formed on the surface of the elastic layer thereof is dried by blowing air at a wind velocity of substantially 0.5 m/sec for 15 min under an environment of 23° C. and 65% RH while it is rotated at the rotation rate of 20 rpm. Thereafter, the roll is calcined at 320° C. for 30 min in a calcining furnace to obtain a fixing roll.

A thickness of a surface layer of the obtained fixing roll is measured and found that, in a widthwise direction of a surface layer, the minimum thickness in the vicinity of both end portions is 23.0 μm, the maximum thickness at a center portion is 48.7 μm and a thickness (average value) at a position 160 mm toward both end portions from the center portion is 23.0 μm. Furthermore, it is found that difference between the maximum value and the minimum value of the thickness of the surface layer in a circumferential direction is 0.5 μm, which means that the thickness of the surface layer in a circumferential direction is constant.

On the other hand, the elongation percentage of a surface of a surface layer of the fixing roll is measured and found that, in a widthwise direction of the surface layer, the elongation percentage at the center portion is 9% and the elongation percentages at positions 160 mm toward both end portions from the center portion are 19%. Further, when the elongation percentages are measured at several points of other positions in a widthwise direction, it is confirmed that as goes from the center portion toward the both end portions, the elongation percentage increases.

Evaluation

The thus obtained fixing roll is mounted on an image formation apparatus (trade name: DOCUCENTRE 450, manufactured by Fuji Xerox Corp.) as a heating roll of a fixing device, and is subjected to evaluations in terms of the sheet wrinkling and the image defect.

In the image formation apparatus, a sheet that is conveyed inside the apparatus is conveyed so that a centerline of the sheet and a center portion of a surface layer of a pressure roll of the image formation apparatus may coincide. Furthermore, since each of a heating roll and a pressure roll that are used in the fixing device originally have a straight shape. When the original heating roll and the pressure roll are used, a pressing force in a widthwise direction of a contact portion is constant, and an average value of the pressing force is 4.0 kgf/cm$^2$ (39.2 N/cm$^2$).

A heating roll that is originally attached to the fixing device has a configuration substantially similar to the fixing roll prepared in Example 1, except that a thickness of a surface layer in a widthwise direction is 30 μm, and it has a flare shape in which the external diameter of the center portion of the roll is smaller than the external diameters of both end portions of the roll so that difference of external diameters from both end portions of the roll toward the center portion is about 80 μm owing to the difference in the thickness of the elastic layer.

The evaluation test is carried out as follows. That is, a fixing temperature, a process speed and a pressing force of a contact portion (nip portion) formed by a pressing device pressed against a roll from a back side of a belt through a heating roll and a pressure belt, respectively, are set at 160° C., 208 mm/s and 30 kgf (294 N), according to oil-less fixing, 30000 A3 sheets (trade name: P SHEET, manufactured by Fuji Xerox Corp.) are continuously fed, followed by equally dividing a whole surface of a sheet into four in a sheet feeding direction to form a solid image (100% image) of four colors of yellow, magenta, cyan and Black (YMCK).

The maximum pressure in a circumferential direction per unit area of a contact portion at this time is measured by use of the tactile sensor system (manufactured by Nitta Corporation) by inserting a sensor sheet (trade name: A3-30L) in the contact portion, followed by equally dividing into 40 parts in an axial direction to measure. The maximum value is 4.2 kgf/cm$^2$ (41.2 N/cm$^2$) and the minimum value is 3.7 kgf/cm$^2$ (36.3 N/cm$^2$), that is, the maximum pressure in a circumferential direction is substantially uniform.

Evaluation results are shown in Table 1 together with forming conditions and various characteristics of surface layers of the fixing rolls prepared by use of an inkjet method.

Evaluation of Wrinkling of Sheet

Evaluation results of the wrinkling of sheet shown in Table 1 are obtained by visually observing obtained images and by evaluating according to the following criteria.

A: No sheet wrinkling is observed

B: 5 sheets or less among 10 sheets have fine undulation while it is not recognized wrinkling of sheet C: Wrinkling of sheet is found in three sheets or less of 10 sheets X: Wrinkling of sheet is found in 3 sheets or more of 10 sheets Evaluation of Image Defect (Graininess)

Evaluation results of the image defect shown in Table 1 are obtained by evaluating of obtained images whether the image defect (graininess) due to a surface layer of the fixing roll is caused or not according to criteria below.

A: Uniform glossiness is observed

B: A little deterioration in the glossiness is observed

C: Difference (graininess) of portions where the glossiness is deteriorated and is not deteriorated is vaguely discernible by visual observation X: Grainy defect that can be clearly discerned with gloss difference is clearly discernible a on an image Evaluation of Image Defect (Streaky Defect)

Evaluation results of the image defect shown in Table 1 are obtained by evaluating of obtained images whether the image defect (streaky defect) due to irregularity of a surface of a surface layer of the fixing roll is caused or not based on the following criteria.

A: No streaky defect is observed

B: Slight streaky is observed when light is reflected

C: Slight streaky is observed when an image is visually observed as it is

X: Streaky is observed when an image is visually observed as it is

Evaluation of Durability

Evaluation results of the durability shown in Table 1 are obtained by visually observing of a surface of a fixing roll after formation of 100000 sheets of images whether scratch or wrinkle is caused or not and an extent thereof and evaluating according to criteria below.

A: Faint wear trace is observed at end portions of a region where a sheet goes past B: Wear trace is observed at end portions of a region where a sheet goes past C: Wear trace and wrinkle are observed at end portions of a region where a sheet goes past X: Wear trace and wrinkle are observed at end portions of a region where a sheet goes past, and a surface layer is worn out and an elastic layer is exposed Example 2

A fixing roll used in Example 2 is obtained and evaluated in the same way as in Example 1, except that, when a surface layer is formed, a liquid droplet diameter of the PFA dispersion liquid ejected from the liquid droplet discharge head onto the surface of the base-roll is set at 11 pl (maximum liquid droplet diameter) at the center portion (a position at 170 mm from any one end in the axial direction of the elastic layer) and 6 pl (minimum liquid droplet diameter) in the vicinity of both end portions (a region from 0 to 20 mm and a region from 320 to 340 mm in an axial direction of an elastic layer) and the maximum and minimum scanning speeds are changed as shown in Table 1. Results are shown in Table 1.

Example 3

A fixing roll used in Example 3 is obtained and evaluated in the same way as in Example 1, except that, when a surface layer is formed, a liquid droplet diameter of the PFA dispersion liquid ejected from the liquid droplet discharge head onto the surface of the base-roll is set at 15 pl (maximum liquid droplet diameter) at the center portion (a position at 170 mm from any one end in the axial direction of the elastic layer) and 8 pl (minimum liquid droplet diameter) in the vicinity of both end portions (a region from 0 to 20 mm and a region from 320 to 340 mm in an axial direction of an elastic layer) and the maximum and minimum scanning speeds are changed as shown in Table 1. Results are shown in Table 1.

Example 4

A fixing roll used in Example 4 is obtained and evaluated in the same way as in Example 1, except that, when a surface layer is formed, a liquid droplet diameter of the PFA dispersion liquid ejected from the liquid droplet discharge head onto the surface of the base-roll is set at 15 pl (maximum liquid droplet diameter) at the center portion (a position at 170 mm from any one end in the axial direction of the elastic layer) and 13 pl (minimum liquid droplet diameter) in the vicinity of both end portions (a region from 0 to 20 mm and a region from 320 to 340 mm in an axial direction of an elastic layer) and the maximum and minimum scanning speeds are changed as shown in Table 1. Results are shown in Table 1.

Example 5

A fixing roll used in Example 5 is obtained and evaluated in the same way as in Example 1, except that, when a surface layer is formed, a liquid droplet diameter of the PFA dispersion liquid ejected from the liquid droplet discharge head onto the surface of the base-roll is set at 15 pl (maximum liquid droplet diameter) at the center portion (a position at 170 mm from any one end in the axial direction of the elastic layer) and 4 pl (minimum liquid droplet diameter) in the vicinity of both end portions (a region from 0 to 20 mm and a region from 320 to 340 mm in an axial direction of an elastic layer) and the maximum and minimum scanning speeds are changed as shown in Table 1. Results are shown in Table 1.

Example 6

A fixing roll used in Example 6 is obtained and evaluated in the same way as in Example 1, except that, when a surface layer is formed, a liquid droplet diameter of the PFA dispersion liquid ejected from the liquid droplet discharge head onto the surface of the base-roll is set at 13 pl (maximum liquid droplet diameter) at the center portion (a position at 170 mm from any one end in the axial direction of the elastic layer) and 6 pl (minimum liquid droplet diameter) in the vicinity of both end portions (a region from 0 to 20 mm and a region from 320 to 340 mm in an axial direction of an elastic layer) and the maximum and minimum scanning speeds are changed as shown in Table 1. Results are shown in Table 1.

Example 7

A fixing roll used in Example 7 is obtained and evaluated in the same way as in Example 1, except that, when a surface layer is formed, a liquid droplet diameter of the PFA dispersion liquid ejected from the liquid droplet discharge head onto the surface of the base-roll is set at 15 μl (maximum liquid droplet diameter) at the center portion (a position at 170 mm from any one end in the axial direction of the elastic layer) and 6 pl (minimum liquid droplet diameter) in the vicinity of both end portions (a region from 0 to 20 mm and a region from 320 to 340 mm in an axial direction of an elastic layer) and the maximum and minimum scanning speeds are changed as shown in Table 1. Results are shown in Table 1.

Example 8

A fixing roll used in Example 8 is obtained and evaluated in the same way as in Example 1, except that, when a surface layer is formed, a liquid droplet diameter of the PFA dispersion liquid ejected from the liquid droplet discharge head onto the surface of the base-roll is set at 8 pl (maximum liquid droplet diameter) at the center portion (a position at 170 mm from any one end in the axial direction of the elastic layer) and 4 pl (minimum liquid droplet diameter) in the vicinity of both end portions (a region from 0 to 20 mm and a region from 320 to 340 mm in an axial direction of an elastic layer) and the maximum and minimum scanning speeds are changed as shown in Table 1. Results are shown in Table 1.

Example 9

A fixing roll used in Example 9 is obtained and evaluated in the same way as in Example 1, except that, when a surface layer is formed, a liquid droplet diameter of the PFA dispersion liquid ejected from the liquid droplet discharge head onto the surface of the base-roll is set at 14 pl (maximum liquid droplet diameter) at the center portion (a position at 170 mm from any one end in the axial direction of the elastic layer) and 6 pl (minimum liquid droplet diameter) in the vicinity of both end portions (a region from 0 to 20 mm and a region from 320 to 340 mm in an axial direction of an elastic layer) and the maximum and minimum scanning speeds are changed as shown in Table 1. Results are shown in Table 1.

Comparative Example 1

A fixing roll used in Comparative example 1 is prepared and evaluated in the same way as Example 1, except that, when a surface layer is formed, a liquid droplet diameter of a PFA dispersion liquid ejected from a liquid droplet discharge head on a surface of an base-roll is set at 10 pl over an entire surface and a moving speed of a head is set as shown in Table 1 so as to be 30 μm in an average film thickness. Results are shown in Table 1.

TABLE 1

| | | Example 1 | Example 2 | Example 3 | Example 4 | Example 5 | Example 6 | Example 7 | Example 8 | Example 9 | Comparative Example 1 |
|---|---|---|---|---|---|---|---|---|---|---|---|
| Surface Layer Forming Conditions | Maximum Liquid droplet Diameter (pl) | 15 | 11 | 15 | 15 | 15 | 13 | 15 | 8 | 14 | 10 |
| | Maximum Scanning Speed (mm/min) | 17.63 | 17.24 | 17.63 | 17.63 | 17.63 | 14.10 | 18.80 | 16.12 | 14.63 | 18.80 |
| | Minimum Liquid droplet Diameter (pl) | 6 | 6 | 8 | 13 | 4 | 6 | 6 | 4 | 6 | 10 |
| | Minimum Scanning Speed (mm/min) | 14.72 | 14.72 | 17.36 | 17.46 | 17.36 | 12.54 | 17.82 | 16.12 | 16.92 | 18.80 |
| | Revolutions (rpm) | 200 | 200 | 200 | 200 | 200 | 200 | 200 | 200 | 200 | 200 |
| Various Characteristics of Fixing Device | Elongation Percentage A of Surface of Outermost Surface at Center Portion (%) | 9.3 | 12.3 | 9.3 | 9.3 | 9.3 | 8.5 | 9.9 | 15.9 | 8.2 | 14.3 |
| | Elongation Percentage B of Surface of Surface Layer at Position 160 mm from Center Portion toward End Portion Side (%) | 19.3 | 19.3 | 17.1 | 10.6 | 34.2 | 16.5 | 23.4 | 31.7 | 22.2 | 14.6 |
| | B/A | 2.09 | 1.57 | 1.85 | 1.14 | 3.69 | 1.93 | 2.37 | 2 | 2.7 | 1.03 |
| | Surface Layer Thickness T1 at Center Portion (μm) | 48.0 | 36.0 | 48.0 | 48.0 | 48.0 | 52.0 | 45.0 | 28.0 | 54.0 | 31.0 |
| | Surface Layer Thickness T2 at Position 160 mm from Center Portion toward Both End Portion Sides (μm) | 23.0 | 23.0 | 26.0 | 42.0 | 13.0 | 27.0 | 19.0 | 14.0 | 34.0 | 30.5 |
| | T1-T2 (μm) | 25.0 | 13.0 | 22.0 | 6.0 | 35.0 | 25.0 | 26.0 | 14.0 | 20.0 | 0.5 |
| | Maximum Thickness of Surface Layer (Tmax (μm)) | 48.7 | 36.4 | 48.8 | 48.5 | 48.3 | 52.5 | 45.9 | 28.3 | 54.5 | 31.2 |
| | Minimum Thickness of Surface Layer (Tmin (μm)) | 22.4 | 22.5 | 25.1 | 41.5 | 12.6 | 26.8 | 18.4 | 13.5 | 19.6 | 30.4 |
| | Positive variation of Thickness in Circumferential Direction of Surface Layer (%) | 1.46 | 1.11 | 1.67 | 1.04 | 0.62 | 0.96 | 2.00 | 1.07 | 0.93 | 0.65 |
| | Negative variation of Thickness in Circumferential Direction of Surface Layer (%) | −2.61 | −2.17 | −3.46 | −1.19 | −3.08 | −0.74 | −3.16 | −3.57 | −2.00 | −0.33 |
| Position where the Fixing Device is attached in Fixing device | | Heating Roll | Heating Roll | Heating Roll | Heating Roll | Heating Roll | Heating Roll | Heating Roll | Heating Roll | Heating Roll | Heating Roll |

TABLE 1-continued

| | | Example 1 | Example 2 | Example 3 | Example 4 | Example 5 | Example 6 | Example 7 | Example 8 | Example 9 | Comparative Example 1 |
|---|---|---|---|---|---|---|---|---|---|---|---|
| Evaluation Result | Evaluation Result of Sheet Wrinkling | A | A | A | C | C | A | A | A | C | X |
| | Image Defect (Graininess) | A | A | A | A | A | C | A | C | C | A |
| | Image Defect (Streaky Defect) | A | A | A | A | A | A | A | A | A | A |
| | Durability | A | A | A | A | C | A | B | C | B | A |

CROSS-REFERENCE TO RELATED APPLICATION

This application claims priority under 35 USC 119 from Japanese Patent Application No. 2006-350162.

What is claimed is:

1. A fixing devise comprising:

a cylindrical base material, with a variation in outer diameter within about ±0.5% when the cylindrical base material is in a circular cylinder tube shape having rigidity;

an elastic layer that is disposed on or above the base material and with a variation in thickness within about ±5%; and a surface layer that is disposed on or above the elastic layer, with a variation, along a circumferential direction of the base material, in thickness of the surface layer within about ±5% and with a surface elongation percentage which increases from a center portion toward both end portions in a widthwise direction of the base material, wherein a ratio (B/A) of a maximum value (B) to a minimum value (A) of the elongation percentages of the surface layer in the widthwise direction is in a range of about 1.25 to about 2.5, and the maximum value of the thickness of the surface layer in the widthwise direction is about 50 μm or less, and the minimum value of the thickness of the surface layer in the widthwise direction is about 20 μm or more.

2. The fixing device of claim 1, wherein:

the length of the surface layer in the widthwise direction is in the range of about 220 mm to about 250 mm; and with respect to the widthwise direction, a ratio (B1/A1) of the elongation percentage (A1) at a center portion of the surface of the surface layer and the elongation percentage (B1) at positions at about 110 mm from the center portion of the surface of the surface layer toward both end portion sides is in the range of about 1.25 to about 2.5.

3. The fixing device of claim 1, wherein:

the length of the surface layer in the widthwise direction is in the range of about 320 mm to about 360 mm; and with respect to the widthwise direction, a ratio (B2/A2) of the elongation percentage (A2) at a center portion of the surface of the surface layer and the elongation percentage (B2) at positions at about 160 mm from the center portion of the surface of the surface layer toward both end portion sides is in the range of about 1.25 to about 2.5.

4. The fixing device of claim 1, wherein in the widthwise direction a thickness of the surface layer decreases from a center portion toward both end portions.

5. The fixing device of claim 4, wherein:

a length of the surface layer in the widthwise direction is in the range of about 220 mm to about 250 mm; and with respect to the widthwise direction, an absolute value of the difference of thickness at a center portion of the surface layer, and thicknesses at positions at about 110 mm from the center portion of the surface layer toward both end portion sides of the surface layer, is in the range of about 10 μm to about 30 μm.

6. The fixing device of claim 4, wherein:

a length of the surface layer in the widthwise direction is in the range of about 320 mm to about 360 mm; and with respect to the widthwise direction, an absolute value of the difference of thickness at a center portion of the surface layer, and thicknesses at positions at about 160 mm from the center portion of the surface layer toward both end portion sides of the surface layer, is in the range of about 10 μm to about 30 μm.

7. A fixing apparatus comprising:

a heating device; and a pressing device disposed in contact with the heating device, at least one of the heating device or the pressing device comprises at least:

a cylindrical base material, with a variation in outer diameter within about ±0.5% when the cylindrical material is in a circular cylinder tube shape having rigidity;

an elastic layer that is disposed on or above the base material and with a variation in thickness within about ±5%; and at least one of the heating device or the pressing device including at least: a cylindrical base material, with a variation in outer diameter within about ±0.5% when the cylindrical base material is in a circular cylinder tube shape having rigidity;

a ratio (B/A) of a maximum value (B) to a minimum value (A) of the elongation percentages of the surface layer in the widthwise direction is in a range of about 1.25 to about 2.5, and the maximum value of the thickness of the surface layer in the widthwise direction is about 50 μm or less, and the minimum value of the thickness of the surface layer in the widthwise direction is about 20 μm or more.

8. The fixing apparatus of claim 7, wherein the variation, along the widthwise direction, of a pressing force that is applied at the contact portion formed by the heating device and the pressing device is within about ±10%.

9. The fixing apparatus of claim 7, wherein:

the length of the surface layer in the widthwise direction is in the range of about 220 mm to about 250 mm; and with respect to the widthwise direction, a ratio (B1/A1) of the elongation percentage (A1) at a center portion of the surface of the surface layer and the elongation percentage (B1) at positions at about 110 mm from the center portion of the surface of the surface layer toward both end portion sides is in the range of about 1.25 to about 2.5.

10. The fixing apparatus of claim 7, wherein:

the length of the surface layer in the widthwise direction is in the range of about 320 mm to about 360 mm; and with respect to the widthwise direction, a ratio (B2/A2) of the elongation percentage (A2) at a center portion of the surface of the surface layer and the elongation percentage (B2) at positions at about 160 mm from the center portion of the surface of the surface layer toward both end portion sides is in the range of about 1.25 to about 2.5.

11. The fixing apparatus of claim 7, wherein in the widthwise direction a thickness of the surface layer decreases from a center portion toward both end portions.

12. The fixing apparatus of claim 11, wherein:

a length of the surface layer in the widthwise direction is in the range of about 220 mm to about 250 mm; and with respect to the widthwise direction, an absolute value of the difference of thickness at a center portion of the surface layer, and thicknesses at positions at about 110 mm from the center portion of the surface layer toward both end portion sides of the surface layer, is in the range of about 10 μm to about 30 μm.

13. The fixing apparatus of claim 11, wherein:

a length of the surface layer in the widthwise direction is in the range of about 320 mm to about 360 mm; and with respect to the widthwise direction, an absolute value of the difference of thickness at a center portion of the surface layer, and thicknesses at positions at about 160 mm from the center portion of the surface layer toward both end portion sides of the surface layer, is in the range of about 10 μm to about 30 μm.

14. An image formation apparatus comprising: a latent image holding member; a charging unit, charging a surface of the latent image holding member; a latent image formation unit, forming a latent image on the charged surface of the latent image holding member; a toner image formation unit, developing the latent image with a developing agent to form a toner image; a transfer unit, transferring the toner image from the surface of the latent image holding member onto a surface of a recording medium; and a fixing unit, fixing a toner image transferred on a surface of the recording medium, the fixing unit including at least:

a heating device; and a pressing device disposed in contact with the heating device, at least one of the heating device or the pressing device including at least: a cylindrical base material, with a variation in thickness within about ±10% when the cylindrical base material is in an endless belt shape having flexibility, or with a variation in outer diameter within about ±0.5% when the cylindrical base material is in a circular cylinder tube shape having rigidity; an elastic layer that is disposed on or above the base material and with a variation in thickness within about ±5%; and a surface layer that is disposed on or above the elastic layer, with a variation, along a circumferential direction of the base material, in the thickness of the surface layer within about ±5% and with a surface elongation percentage, which increases from a center portion toward both end portions in a widthwise direction of the base material, wherein a ratio (B/A) of a maximum value (B) to a minimum value (A) of the elongation percentages of the surface layer in the widthwise direction is in a range of about 1.25 to about 2.5, and the maximum value of the thickness of the surface layer in the widthwise direction is about 50 μm or less, and the minimum value of the thickness of the surface layer in the widthwise direction is about 20 μm or more.

15. The image formation apparatus of claim 14, wherein the variation, along the widthwise direction, of a pressing force that is applied at the contact portion formed by the heating device and the pressing device is within about ±10%.

16. The image formation apparatus of claim 14, wherein:

the length of the surface layer in the widthwise direction is in the range of about 220 mm to about 250 mm; and with respect to the widthwise direction, a ratio (B1/A1) of the elongation percentage (A1) at a center portion of the surface of the surface layer and the elongation percentage (B1) at positions at about 110 mm from the center portion of the surface of the surface layer toward both end portion sides is in the range of about 1.25 to about 2.5.

17. The image formation apparatus of claim 14, wherein:

the length of the surface layer in the widthwise direction is in the range of about 320 mm to about 360 mm; and with respect to the widthwise direction, a ratio (B2/A2) of the elongation percentage (A2) at a center portion of the surface of the surface layer and the elongation percentage (B2) at positions at about 160 mm from the center portion of the surface of the surface layer toward both end portion sides is in the range of about 1.25 to about 2.5.

18. The image formation apparatus of claim 14, wherein in the widthwise direction a thickness of the surface layer decreases from a center portion toward both end portions.

19. The image formation apparatus of claim 18, wherein:

a length of the surface layer in the widthwise direction is in the range of about 220 mm to about 250 mm; and with respect to the widthwise direction, an absolute value of the difference of thickness at a center portion of the surface layer, and thicknesses at positions at about 110 mm from the center portion of the surface layer toward both end portion sides of the surface layer, is in the range of about 10 μm to about 30 μm.

20. The image formation apparatus of claim 18, wherein:

a length of the surface layer in the widthwise direction is in the range of about 320 mm to about 360 mm; and with respect to the widthwise direction, an absolute value of the difference of thickness at a center portion of the surface layer, and thicknesses at positions at about 160 mm from the center portion of the surface layer toward both end portion sides of the surface layer, is in the range of about 10 μm to about 30 μm.

* * * * *